US012419363B2

(12) United States Patent
Melendez et al.

(10) Patent No.: US 12,419,363 B2
(45) Date of Patent: Sep. 23, 2025

(54) SHAPING GARMENT WITH ADJUSTABLE LOW BACK

(71) Applicant: Spanx, LLC, Atlanta, GA (US)

(72) Inventors: Angelica Melendez, Atlanta, GA (US); Jennifer Johnson, Atlanta, GA (US); Elena Novosiolova, Atlanta, GA (US)

(73) Assignee: Spanx, LLC, Atlanta, GA (US)

( * ) Notice: Subject to any disclaimer, the term of this patent is extended or adjusted under 35 U.S.C. 154(b) by 0 days.

(21) Appl. No.: 18/794,010

(22) Filed: Aug. 5, 2024

(65) Prior Publication Data

US 2025/0212977 A1 Jul. 3, 2025

Related U.S. Application Data

(63) Continuation of application No. 17/125,241, filed on Dec. 17, 2020, now Pat. No. 12,082,627, which is a continuation of application No. 15/964,942, filed on Apr. 27, 2018, now Pat. No. 10,881,152.

(60) Provisional application No. 62/492,650, filed on May 1, 2017.

(51) Int. Cl.

| | |
|---|---|
| ***A41C 1/02*** | (2006.01) |
| ***A41B 9/08*** | (2006.01) |
| ***A41C 1/06*** | (2006.01) |
| ***A41C 3/08*** | (2006.01) |
| ***A41C 5/00*** | (2006.01) |

(52) U.S. Cl.

CPC ..... *A41C 1/02* (2013.01); *A41B 9/08* (2013.01); *A41C 1/06* (2013.01); *A41C 3/08* (2013.01); *A41C 5/005* (2013.01); *A41B 2400/38* (2013.01)

(58) Field of Classification Search

CPC .... A41C 1/02; A41C 1/06; A41C 3/08; A41B 2400/38; A41B 9/08

See application file for complete search history.

(56) References Cited

U.S. PATENT DOCUMENTS

| | | | | |
|---|---|---|---|---|
| 1,531,814 | A | 3/1925 | Reynolds | |
| 1,755,827 | A | 4/1930 | Kops | |
| 1,891,775 | A | 12/1932 | Neilson | |
| 1,927,018 | A | 9/1933 | Bloom | |
| 1,944,591 | A | 1/1934 | Brown | |
| 2,031,022 | A | 2/1936 | Wipperman | |
| 2,107,121 | A | 2/1938 | Kops | |
| 2,279,222 | A * | 4/1942 | Bowman ..... | A41D 7/00 2/67 |
| 2,579,547 | A | 12/1951 | Cadous | |
| 2,598,172 | A | 5/1952 | Wilma | |

(Continued)

*Primary Examiner* — Gloria M Hale

(74) *Attorney, Agent, or Firm* — Meunier Carlin & Curfman LLC

(57) ABSTRACT

Designing shapewear for special occasion garments with low cut necklines and back lines can be especially challenging. The challenge lies in constructing a garment that effectively shapes the wearer while simultaneously eliminating significant amounts of material from the chest and/or back region. Disclosed herein are shaping garments designed to be worn underneath garments with low cut back lines. The shaping garment includes a space in the back shaping region on its rear side, such that the shaping garment is not visible beneath an ultra low-back special occasion garment. A removable back adjuster can be used to bridge the space to provide additional shaping support when ultra low-back mode is not required by the special occasion garment.

23 Claims, 17 Drawing Sheets

(56) References Cited

U.S. PATENT DOCUMENTS

| | | | | |
|---|---|---|---|---|
| 2,634,417 | A | 4/1953 | Kaplan | |
| 2,668,954 | A | 2/1954 | Frohlich | |
| 2,678,446 | A | 5/1954 | Fellner | |
| 2,926,668 | A | 3/1960 | Schaumer | |
| 3,046,990 | A | 7/1962 | Herma | |
| 3,173,421 | A | 3/1965 | Steiner | |
| 3,191,603 | A | 6/1965 | Marino | |
| 3,332,426 | A | 7/1967 | Kaplan | |
| 3,411,509 | A | 11/1968 | Sachs | |
| 3,418,700 | A | 12/1968 | Edelman | |
| 4,956,878 | A | 9/1990 | Boynton | |
| 5,904,607 | A | 5/1999 | Abadi | |
| 6,766,533 | B1 | 7/2004 | Meier et al. | |
| 6,811,462 | B1 | 11/2004 | Kenneally | |
| 8,425,275 | B2 | 4/2013 | Noel | |
| 8,460,055 | B2 | 6/2013 | Cheng | |
| 8,574,026 | B2 * | 11/2013 | Livingstone | A41D 31/18 450/33 |
| 9,456,639 | B2 | 10/2016 | Aylward | |
| 9,936,739 | B2 | 4/2018 | Smith | |
| 10,448,679 | B1 | 10/2019 | Roddis et al. | |
| 10,660,373 | B2 | 5/2020 | Martin | |
| 10,881,152 | B2 * | 1/2021 | Melendez | A41C 5/005 |
| 10,959,465 | B2 | 3/2021 | Melendez et al. | |
| 11,058,155 | B2 | 7/2021 | Roddis et al. | |
| 11,234,468 | B2 | 2/2022 | Melendez et al. | |
| 12,082,627 | B2 * | 9/2024 | Melendez | A41C 3/08 |
| 12,133,562 | B2 * | 11/2024 | Melendez | B32B 7/09 |
| 2006/0276103 | A1 | 12/2006 | Teng | |
| 2007/0026767 | A1 | 2/2007 | Scheininger et al. | |
| 2007/0079419 | A1 | 4/2007 | Spruill | |
| 2007/0123148 | A1 | 5/2007 | Heer | |
| 2008/0134406 | A1 | 6/2008 | Shih et al. | |
| 2008/0194179 | A1 | 8/2008 | Leung | |
| 2009/0300816 | A1 | 12/2009 | Brito et al. | |
| 2010/0184355 | A1 | 7/2010 | Kennedy | |
| 2011/0003533 | A1 | 1/2011 | Caruso et al. | |
| 2011/0124268 | A1 | 5/2011 | Cheng | |
| 2011/0209262 | A1 | 9/2011 | Waldman et al. | |
| 2012/0060253 | A1 | 3/2012 | Bergin (Nee Madonna) et al. | |
| 2012/0149277 | A1 | 6/2012 | Moses-Jones et al. | |
| 2014/0357159 | A1 | 12/2014 | Balland | |
| 2015/0101099 | A1 | 4/2015 | Nantong | |
| 2015/0147939 | A1 | 5/2015 | Chen | |
| 2016/0015090 | A1 | 1/2016 | Mazourik | |
| 2016/0135512 | A1 | 5/2016 | Smith | |
| 2016/0150833 | A1 | 6/2016 | Spicer | |
| 2016/0157529 | A1 | 6/2016 | Hoeven | |
| 2016/0182602 | A1 | 6/2016 | Cordonnier | |
| 2016/0235129 | A1 | 8/2016 | Jackson | |
| 2018/0116306 | A1 | 5/2018 | Andre | |
| 2018/0310638 | A1 * | 11/2018 | Melendez | A41C 1/02 |
| 2019/0320738 | A1 | 10/2019 | Kiuchi et al. | |
| 2019/0330773 | A1 | 10/2019 | Hanson Allen et al. | |
| 2020/0107587 | A1 | 4/2020 | Martin | |
| 2020/0323278 | A1 | 10/2020 | Roddis et al. | |

* cited by examiner

SHAPING GARMENT WITH ADJUSTABLE LOW BACK

CROSS-REFERENCE TO RELATED APPLICATIONS

This application is a continuation of U.S. application Ser. No. 17/125,241, filed Dec. 17, 2020, now U.S. Pat. No. 12,082,627, which is a continuation of U.S. application Ser. No. 15/964,942, filed Apr. 27, 2018, now U.S. Pat. No. 10,881,152, which claims the benefit of U.S. Provisional Application 62/492,650, filed May 1, 2017. Each of the aforementioned applications is incorporated by reference in its entirety for all purposes.

BACKGROUND

Special occasions often lead to the purchase of unique garments that may only be used once or a few times. These garments can have interesting necklines, back lines, breast padding, and long, embellished skirts and underskirts that add weight to the garment. Shaping garments can be worn under the special occasion garment to smoothen and shape the wearer's overall silhouette. Designing shaping garments for special occasion garments can be especially challenging because it should be versatile enough to adapt to the many types of unique features that special occasion garments can include.

SUMMARY

Designing shapewear for special occasion garments with low cut necklines and back lines can be especially challenging. The challenge lies in constructing a garment that effectively shapes the wearer while simultaneously eliminating significant amounts of material from the chest and/or back region. Disclosed herein are shaping garments designed to be worn underneath garments with low cut back lines. The shaping garment includes a space in the back shaping region on its rear side to ensure that the shaping garment is not visible beneath an ultra low-back special occasion garment. A removable back adjuster can be used to bridge the space in the rear side of the garment to provide additional shaping support when ultra low-back mode is not required by the special occasion garment.

Shaping garments disclosed herein have a superior edge that dips to a rear lowermost area on the rear side of the garment. The superior edge extends upward from the rear lowermost area, partially separating the rear side into left and right back shaping regions. The superior edge thereby defines a space between the left back shaping region and the right back shaping region. In some embodiments, a facing elastic can be positioned adjacent the superior edge on an interior side of the rear side of the garment. For example, a facing elastic can run along the portion of the superior edge that defines the space between the left back shaping region and the right back shaping region.

The shaping garments can also include left and right closure mechanisms on the rear side of the garment, and a removable back adjuster that bridges the space between the left and right back shaping regions. The removable back adjuster includes a first portion of the left closure mechanism and a first portion of the right closure mechanism. The first portions of the left and right closure mechanisms are configured to adjoin the back adjuster to the left and right back shaping regions (for example, via second portions of the left and right closure mechanisms that are attached to the left and right back shaping regions). In some embodiments, the left closure mechanism and/or the right closure mechanism can include hook and/or eye fasteners. The removable back adjuster can also include a highly elastic region, which can be positioned between the left closure mechanism and the right closure mechanism.

Some embodiments of the shaping garment can include left and right leg portions with seamless inferior edges.

Some embodiments of the shaping garments disclosed herein include at least one breast supporting portion positioned on a front side of the shaping garment. In some embodiments, left and right breast supporting portions each comprise a molded inner layers. The left and right breast supporting portions can also include a strip of supporting fabric positioned between the molded inner layer and an outer layer of fabric. An elastic band can be positioned inferior to the breast supporting portion, and the elastic band can extend laterally towards the rear side of the shaping garment. In some embodiments, the elastic band extends underneath an exterior layer of the shaping garment. In some embodiments, the elastic band extends to the rear side of the shaping garment underneath the exterior layer of the left back shaping region and the exterior layer of the right back shaping region. A lateral elastic band seam can laterally across a superior region of the elastic band, attaching the elastic band to an exterior layer of the shaping garment. An inferior region of the elastic band can remain unattached to the exterior layer of the shaping garment.

In some embodiments, the elastic band can include the second portions of the left and right closure mechanisms, which are configured to attach to the first portions of the left and right closure mechanisms positioned on the removable back adjuster. As such, the elastic band is configured to attach to the removable back adjuster. In some embodiments, the elastic band includes left and right eye sets and the removable back adjuster comprises left and right hook sets. The hook sets can curve outward and toward an exterior surface of the removable back adjuster.

In some embodiments, a superior edge of the shaping garment includes a front lowermost area positioned on a front side of the shaping garment. The superior edge extends upward from the front lowermost area. This at least partially separates the front side of the garment into a left breast supporting portion and a right breast supporting portion and defines a space between the left and right breast supporting portions. In some embodiments, the superior edge defines a U-shaped space as it progressively diverges extending upward from the front lowermost area. The edge defining the U-shaped space can be attached to a U-shaped wire. The U-shaped wire can be enclosed in a wire casing. In some embodiments, left and right portions of an elastic band are affixed to the U-shaped wire. The left and right portions of the elastic band extends toward the rear side of the shaping garment. The left portion of the elastic band can include a portion of a left closure mechanism and the right portion of the elastic band can include a portion of the right closure mechanism, such that the elastic band is configured to attach to a removable back adjuster.

In some embodiments, a front side the shaping garment further can also include left and right front shaping regions. At least one shoulder strap can extend from one of the front shaping regions toward the opposite front shaping region, or toward the rear side of the shaping garment. In some embodiments, the shoulder strap(s) are removably connectable to shoulder strap tabs positioned near the superior edge of the shaping garment. In an embodiment, one shoulder strap can extend from the left front shaping region to the right front shaping region, such that the shaping garment can be worn in a halter configuration.

Methods of making shaping garments are also disclosed herein. The method of making can include cutting a left rear panel from a fabric sheet such that the left rear panel narrows as it extends toward a superior portion of the left panel, creating a narrowing left superior rear portion. The method can further include cutting a right rear panel from a fabric sheet such that the right rear panel narrows as it extends toward a superior portion of the right panel, creating a narrowing right superior rear portion. The method can further include attaching a portion of a left closure mechanism to the right edge of the narrowing left superior rear portion, and attaching a portion of a right closure mechanism to the left edge of the narrowing right superior rear portion. The right inferior edge of the left rear panel can be sewn to a left inferior edge of the right rear panel to form a rear side of the shaping garment. The narrowing left superior rear portion and the narrowing right superior rear portion can remain unattached, thereby defining the space in the rear side of the shaping garment. The method can also include sewing the rear side of the shaping garment to a front panel of the garment to form a front side of the shaping garment. A removable back adjuster can be attached to the left and right closure mechanisms to bridge the space on the rear side of the shaping garment.

Some embodiments of the methods can include attaching a left facing elastic to the superior portion of the left rear panel adjacent the space on the rear side of the shaping garment and attaching a right facing elastic to the superior portion of the right rear panel adjacent the space on the rear side of the shaping garment.

In some embodiments, at least one elastic band can be attached along an interior, superior edge of the rear side of the shaping garment. Some embodiments of the methods can include extending a left elastic band from the rear interior side of the shaping garment to the front side of the shaping garment, and extending a right elastic band from the rear interior side of the shaping garment to the front side of the shaping garment. Some embodiments can include attaching the left elastic band to a U-shaped wire on the front side of the shaping garment, and attaching the right elastic band to the U-shaped wire on the front side of the shaping garment.

Some embodiments of the methods include attaching left and right breast supporting portions along a superior edge of the front side of the shaping garment. For example, a superior edge of at least one elastic band can be attached to an interior, superior edge of the front panel and to the inferior edges of the left and/or right breast supporting portion. A superior edge of the front panel can also be attached to a U-shaped wire, which can be attached to the elastic band and the left and/or right breast supporting portions. panels curve outward and toward an exterior surface of the removable back adjuster.

DETAILED DESCRIPTION

Designing shapewear for special occasion garments with low cut necklines and back lines can be especially challenging. The challenge lies in constructing a garment that effectively shapes the wearer while simultaneously eliminating significant amounts of material from the chest and/or back region. Disclosed herein are shaping garments designed to be worn underneath garments with low cut back lines. The shaping garment includes a space in the back shaping region on its rear side, such that the shaping garment is not visible beneath an ultra low-back special occasion garment. A removable back adjuster can be used to bridge the space in the rear side of the garment to provide additional shaping support when ultra low-back mode is not required by the special occasion garment.

This description refers to certain aspects of the shaping garment relative to other aspects of the shaping garment or to the body of a wearer. As used herein, superior indicates a direction that is closer to the wearer's head. Inferior indicates a direction that is closer to the wearer's feet. Upward, upper, or uppermost indicates a superior direction, or toward a wearer's head. Downward and lower or lower most indicates an inferior direction, or toward a wearer's feet. The longitudinal direction refers to an axis extending between the superior and inferior edges of the garment, or between the wearer's head and feet. The terms right and left are in reference to the wearer's body. Lateral indicates a direction toward the wearer's sides, whereas medial indicates a direction toward the wearer's center. Some of the figures include the letters R and L as right and left directional indicators. Exterior refers to farther from the wearer's body, whereas interior and underneath refer to closer to the wearer's body.

As used herein, fixedly attached is defined as attached via sewing or bonding. Seamlessly attached is defined as continuously formed as one stretch of fabric. Seamless attachment can be achieved by knitting two or more portions or panels of the undergarment together as one piece of fabric, such that there is no seam joining the portions. This can be achieved by using a seamless knitting machine, a hosiery machine, or other knitting machine. Seamless attachment can also be done by continuously forming two or more portions or panels as one stretch of woven or non-woven fabric.

Figure 1:
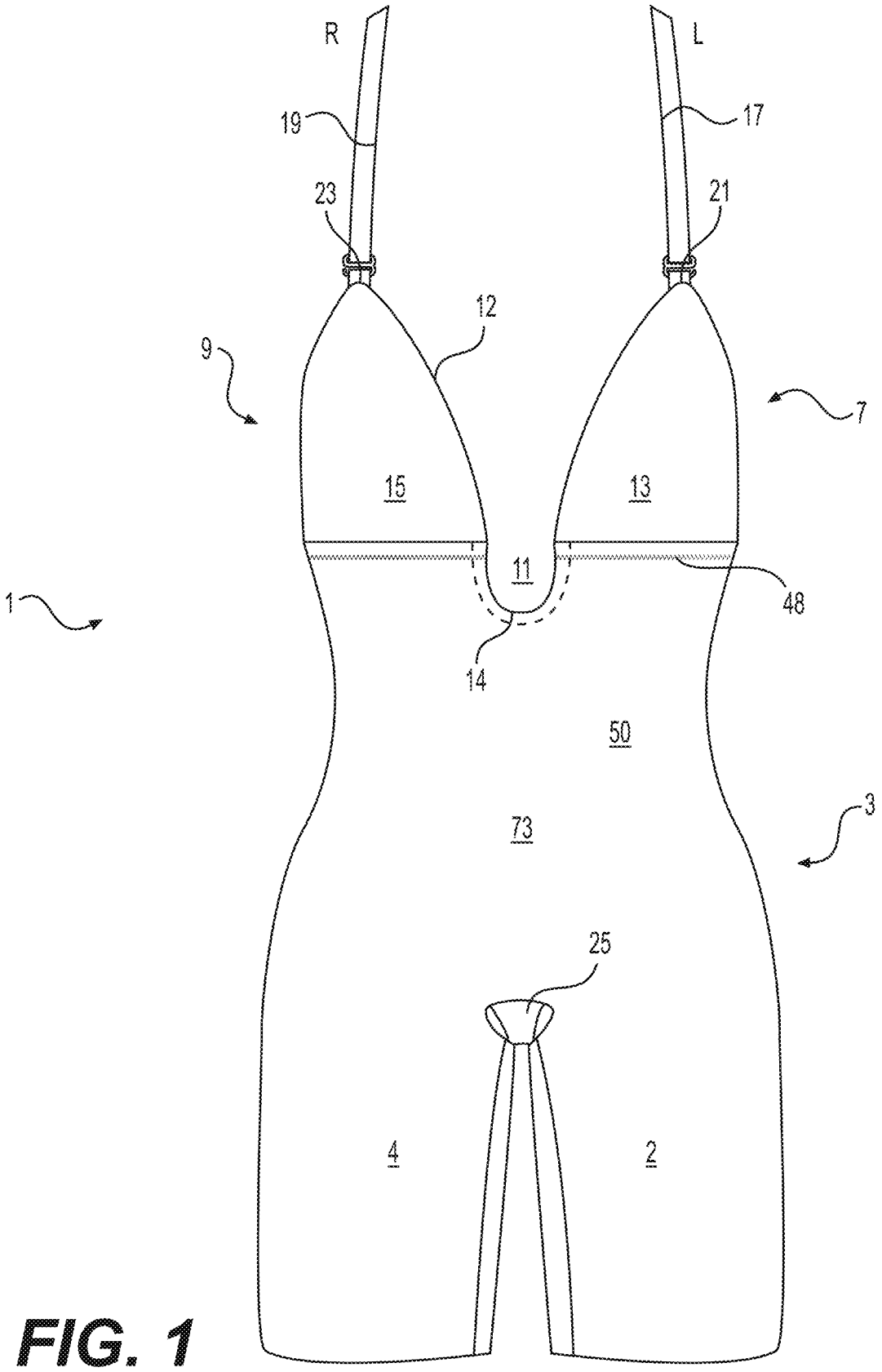
FIG. 1 illustrates a front view of the outside of a shaping garment.
Figure 2:
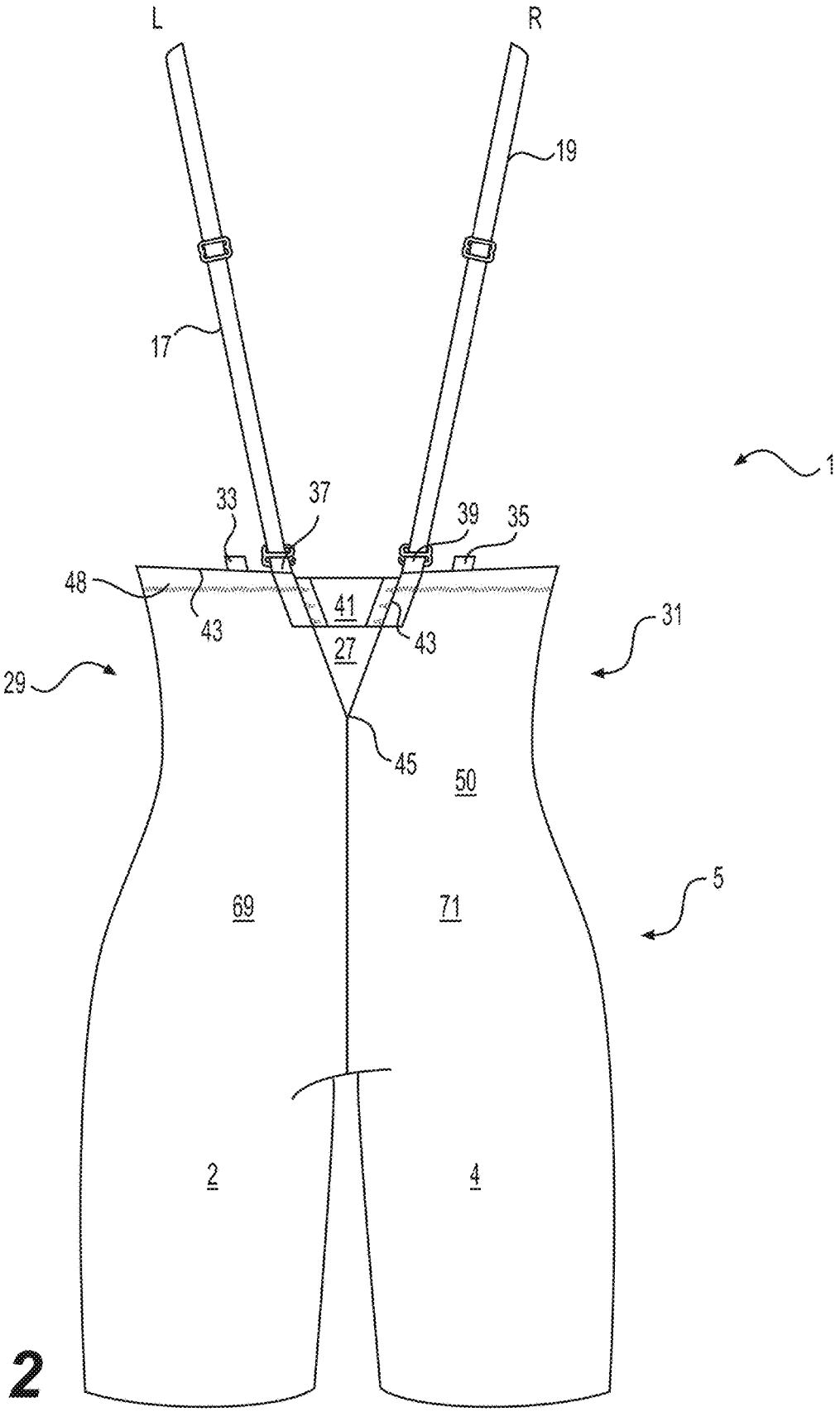
FIG. 2 illustrates a rear view of the outside of a shaping garment.

FIGS. 1 and 2 show front and back views, respectively, of one embodiment of the shaping garment 1 disclosed herein. As shown in FIGS. 1 and 2, the shaping garment 1 can be constructed as a bodysuit, with or without leg portions. The shaping garment 1 shown includes left and right leg portions 2, 4. Alternatively, the shaping garment 1 could be constructed as a bustier, without a crotch region or leg portions. Embodiments that include leg portions can have seamless inferior edges to reduce bulkiness and improve overall comfort to the wearer.

The shaping garment 1 embodiment shown includes front side 3 and rear side 5. On the front side 3 of this embodiment, left and right front shaping regions 7, 9 are partially separated from each other by a U-shaped space 11, which prevents the shaping garment 1 from being seen beneath a special occasion garment having a low neckline. The U-shaped space 11 is defined by the front superior edge 12 of the shaping garment 1. The front superior edge 12 extends upward from its front lowermost area 14, progressively diverging to define a space that widens in the superior direction. Some embodiments of the shaping garment 1 could instead have a V-shaped space, whereas other embodiments may have no space between the left and right front shaping regions 7, 9, forming instead a single breast supporting region with a superior edge closer to the neck of the wearer. Still other embodiments could have a general front side widening space that widens as it extends in the superior direction but that is a shape other than a U or a V. Other embodiments could have a space that ends abruptly such that the lower side of the space appears to be a portion of a square or a rectangle. For a square or rectangular space, the superior edge of the garment would extend horizontally along the lowermost area 14 and then rise at right angles and extend upward toward wearer's head.

As shown in the embodiment of FIG. 1, left and right front shaping regions 7, 9 can include left and right breast supporting portions 13, 15 positioned on either side of the U-shaped space 11. The left and right shaping regions 7, 9 can be attached, either permanently or non-permanently, to left and right shoulder straps 17, 19 at left and right front shoulder strap tabs 21, 23. In some embodiments, the shaping garment can include a specialized construction, or gusset 25, in the crotch region. The gusset material can be attached to the shaping garment 1, for example, by an overlock stitch. The gusset 25 can enable the user to use the bathroom without removing shaping garment 1. Specialized gussets 25 are described elsewhere, such as in U.S. Patent Application No. 62/491,756 and Ser. No. 15/964,516, which are incorporated by reference in their entireties. For example, the gusset can include an access space, or a void, in the garment 1, that enables the wearer to use the restroom without removing the garment 1. In some embodiments, the access space can be partially covered by two side cover panels that extend from the right and left leg portions inward to partially or completely cover the access space. The side cover panels can be formed seamlessly with other parts of the garment 1, or they can be fixedly attached, for example, by sewing or bonding. In some embodiments, the gusset can include a highly stretchable panel of material that extends from the front of the garment to the back, over the access space, in the crotch region. The highly stretchable panel of material may be included with or without the side cover panels. It can be formed seamlessly with other parts of the garment 1, or may be fixedly attached, for example, by sewing or bonding. The highly stretchable panel of material has a high degree of elongation and recovery, such that it can be moved with just one hand and easily put back into place when finished. Gusset materials will be described in more detail, below.

Referring now to FIG. 2, the rear side 5 of shaping garment 1 includes a V-shaped space 27, which partially separates the rear side 5 into left and right back shaping regions 29, 31. The V-shaped space 27 is defined by the superior edge 43 of the shaping garment 1, which progressively diverges as it extends upward from its rear lowermost area 45. While the embodiment shown has a V-shaped space 27, other embodiments of the shaping garment 1 could instead have a U-shaped space. Still other garments can have a space that generally widens as it extends in the superior direction on the rear side, creating a shape other than a U or a V. Other embodiments could have a space in the rear side of the garment that ends abruptly, such that the lower side of the space appears to be a portion of a square or a rectangle. For a square or rectangular space, the superior edge of the garment would extend horizontally along the lowermost area 45, and then rise at right angles and extend upward toward the wearer's head. As noted above, the space 27 in the rear side 5 of the shaping garment 1 prevents the shaping garment 1 from being seen underneath an ultra low-back special occasion garment. Some embodiments can include a facing elastic attached along the superior edge, adjacent the space 27 in the rear side of the garment. This facing elastic is shown as dotted lines around the space 27 in FIG. 4. The facing elastic helps to stabilize the space 27 and limit the extent that it stretches on the wearer's body.

Figure 7B:
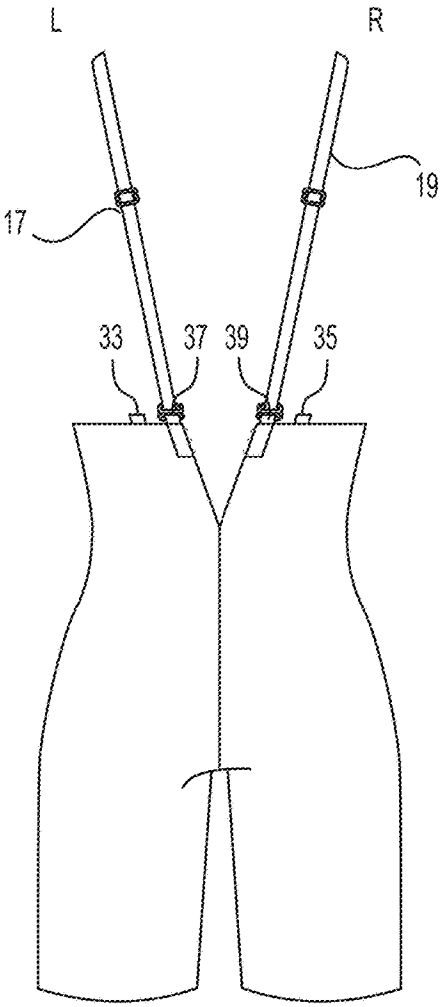
FIGS. 7A and 7B illustrate rear views of the shaping garment in ultra low-back mode with the shoulder straps in the narrow configuration.
Figure 7A:
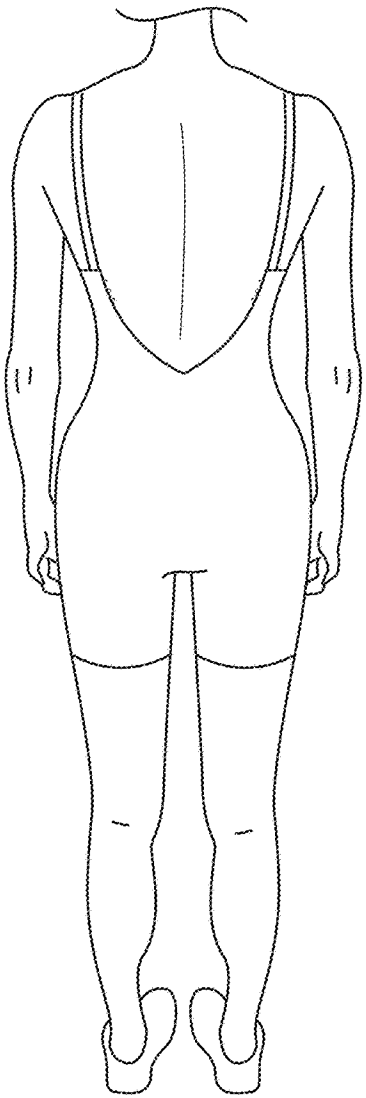
Figure 8B:
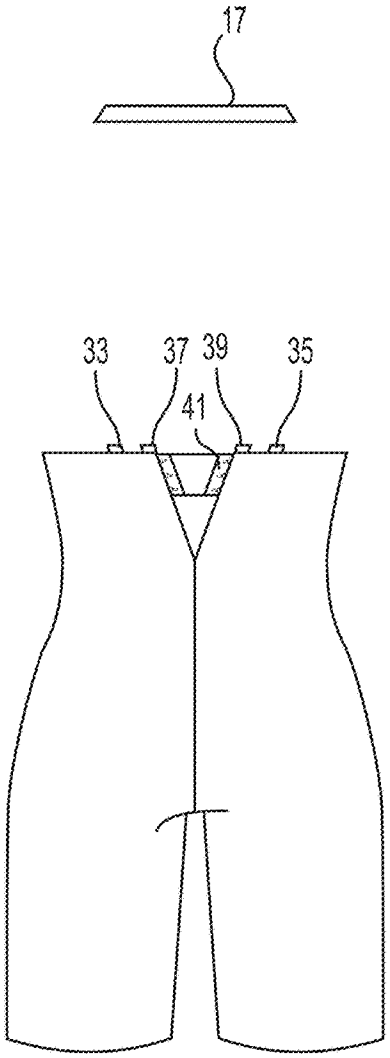
FIGS. 8A and 8B illustrate rear views of the shaping garment in low-back and with the shoulder straps in the halter configuration.
Figure 8A:
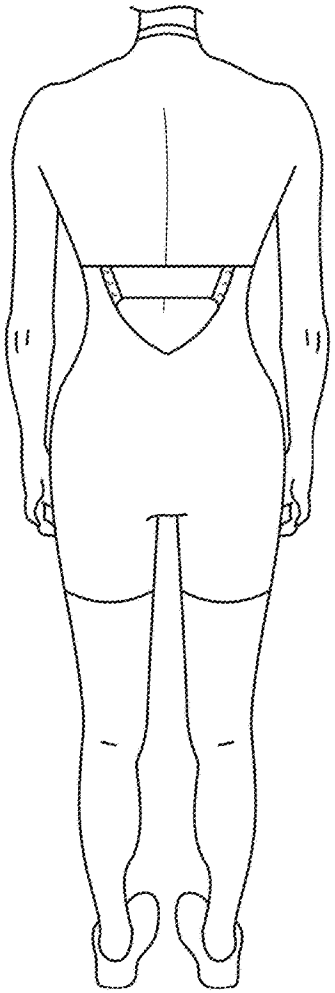
Figure 9B:
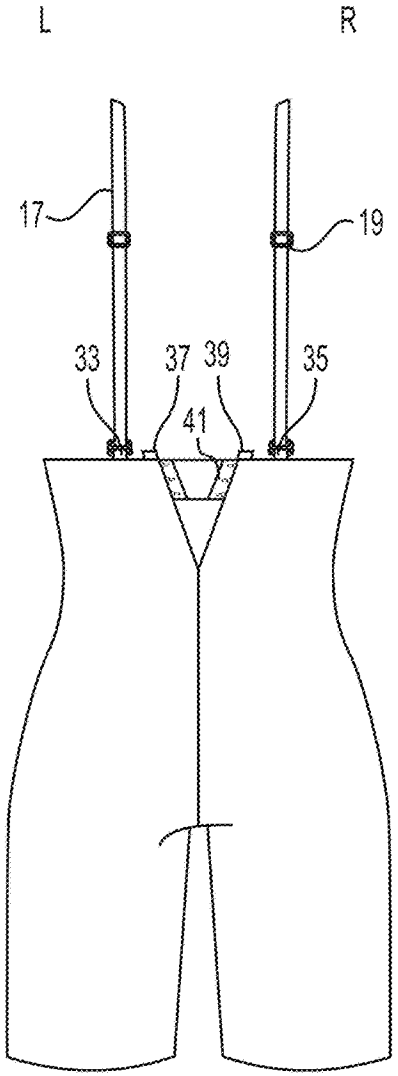
FIGS. 9A and 9B illustrate rear views of the shaping garment in low-back mode with the shoulder straps in a traditional configuration.
Figure 9A:
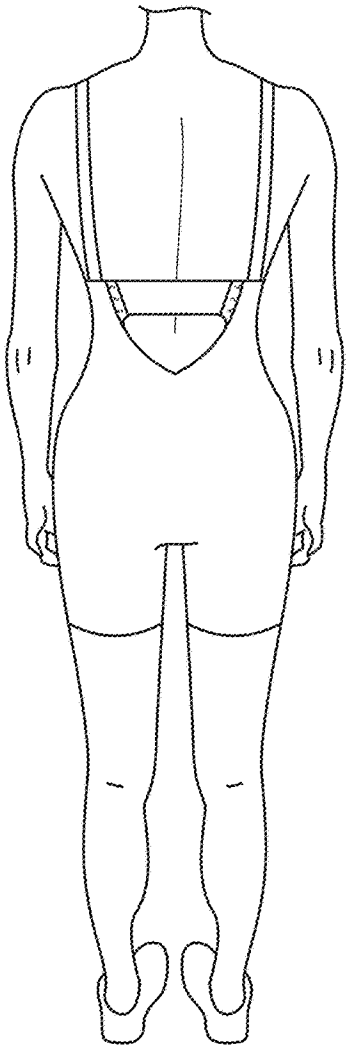
Figure 10:
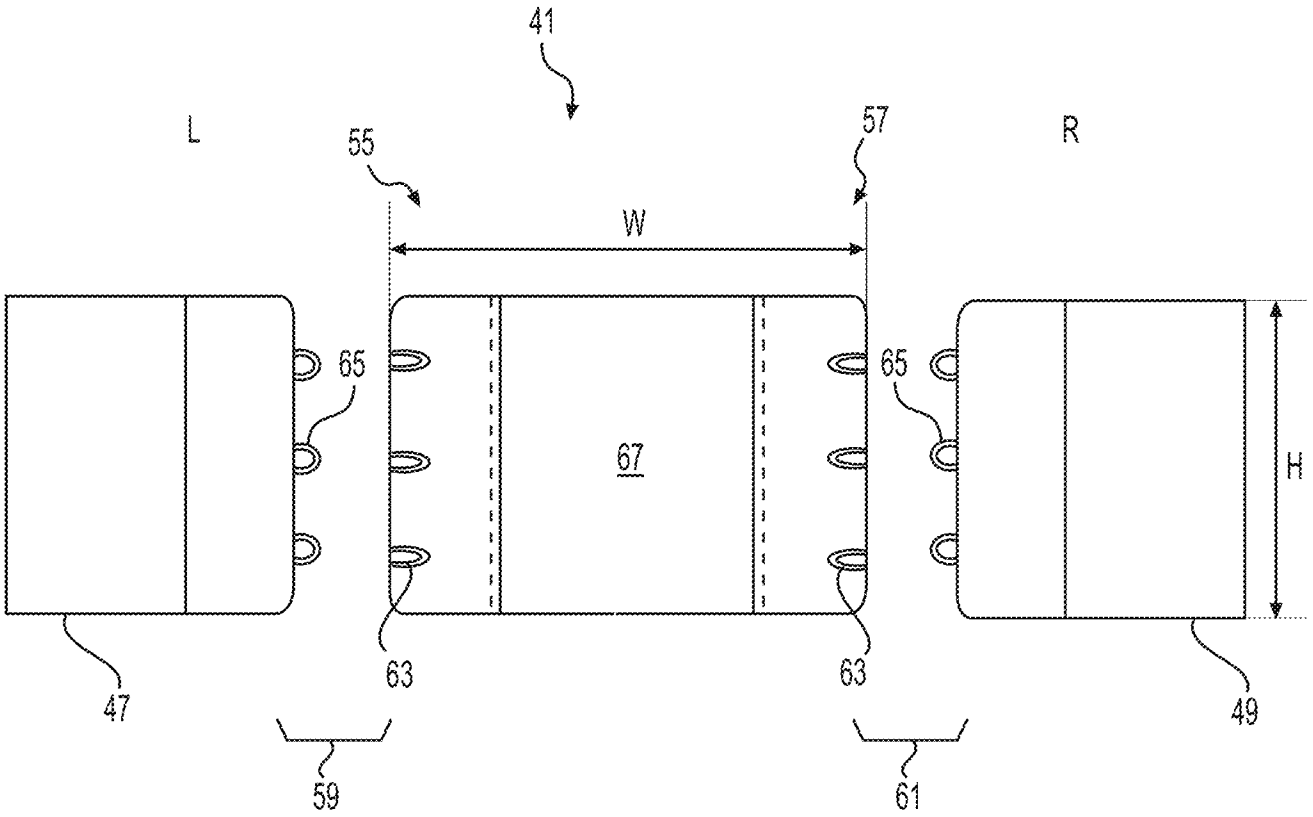
FIG. 10 illustrates a removable back adjuster and left and right portions of an elastic band.

The rear side 5 of the shaping garment 1 also includes a removable back adjuster 41, which can be reversibly attached to the shaping garment 1 to allow it to be worn in either in an ultra low-back mode (without the back adjuster 41 as shown, for example, in FIGS. 7A and 7B) or in a low-back mode (with the back adjuster 41 as shown, for example, in FIGS. 8A, 8B, 9A, and 9B). The removable back adjuster 41 is shown in FIG. 10 and described in greater detail below.

Figure 12:
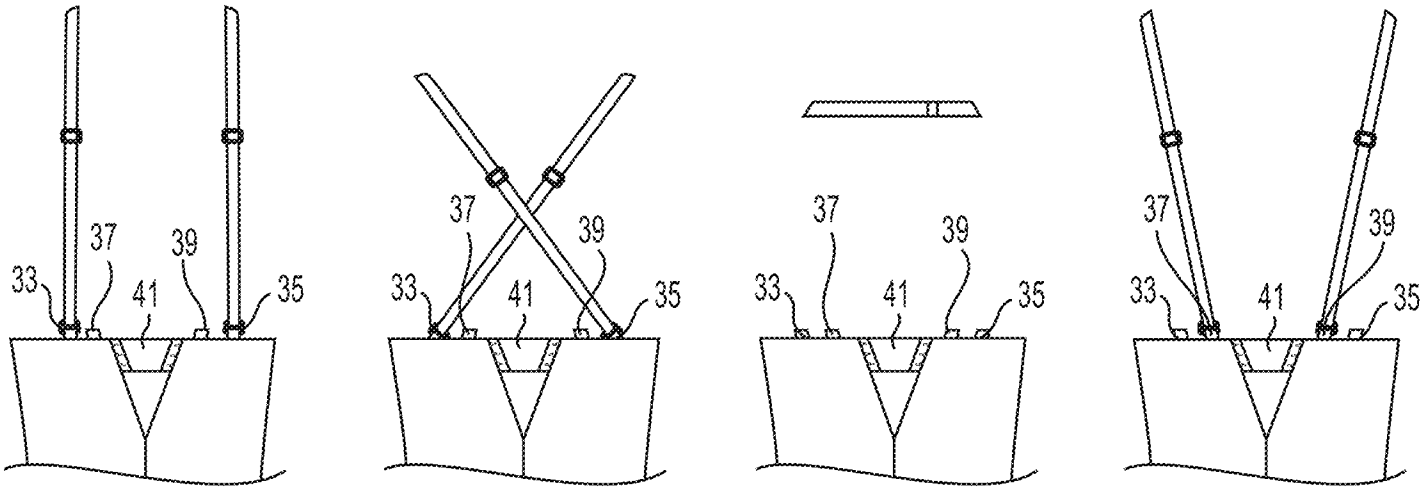
FIG. 12 illustrates a variety of different shoulder strap configurations.

Referring again to FIGS. 1 and 2, shoulder strap tabs 21, 23, 33, 35, 37 and 39 are positioned near the superior edges 12 and 43 of the shaping garment 1. Removably connectable left and right shoulder straps 17, 19 can extend from left and right front shoulder strap tabs 21, 23 to the rear side 5 of the garment, where they can be attached to rear shoulder strap tabs 33, 35, 37 and/or 39 at a variety of locations. For example, in this embodiment, there is an outer pair of left and right rear shoulder strap tabs 33, 35 and an inner pair of left and right rear shoulder strap tabs 37, 39. The inner pair of shoulder strap tabs 37, 39 are closer to the central back seam 32 than the outer pair of shoulder strap tabs 33, 35. In some embodiments, such as the halter mode shown in FIGS. 8A and B, a single shoulder strap 17 can extend from a left front shoulder strap tab 21 on the front shaping region 7 to a right front shoulder strap tab 23 on the right front shaping region 9, or vice versa. FIG. 12 demonstrates a variety of strap configurations, including traditional (utilizing the outer rear shoulder strap tabs 33, 35), criss-cross (utilizing either the outer rear shoulder strap tabs 33, 35, as shown, or the inner rear shoulder strap tabs 37, 39), halter (where a single shoulder strap 17 extends between the left front shaping region 7 and the right front shaping region 9 using only the front strap tabs 21, 23) or narrow (utilizing the inner rear shoulder straps tabs 37, 39). Though the removable back adjuster 41 is shown bridging the space 27 with all of the strap configurations of FIG. 12, it should be understood that it does not have to be worn with any of these strap configurations. The combined removability of the back adjuster 41 and the variety of shoulder strap configurations give the shaping garment 1 an even greater degree of versatility to adapt to the wide variety of special occasion garment styles.

Figure 3:
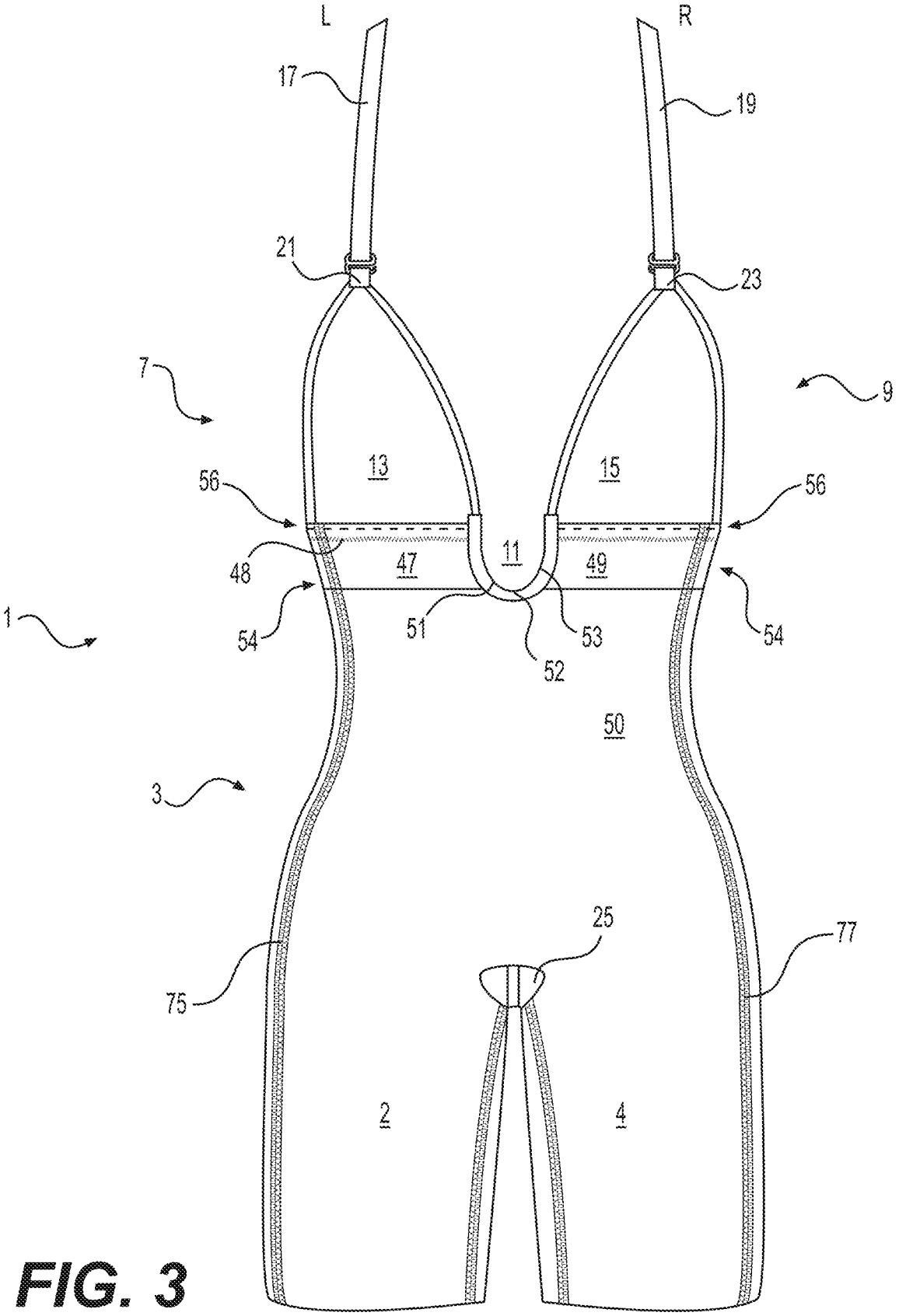
FIG. 3 illustrates a front view of the inside of a shaping garment.
Figure 4:
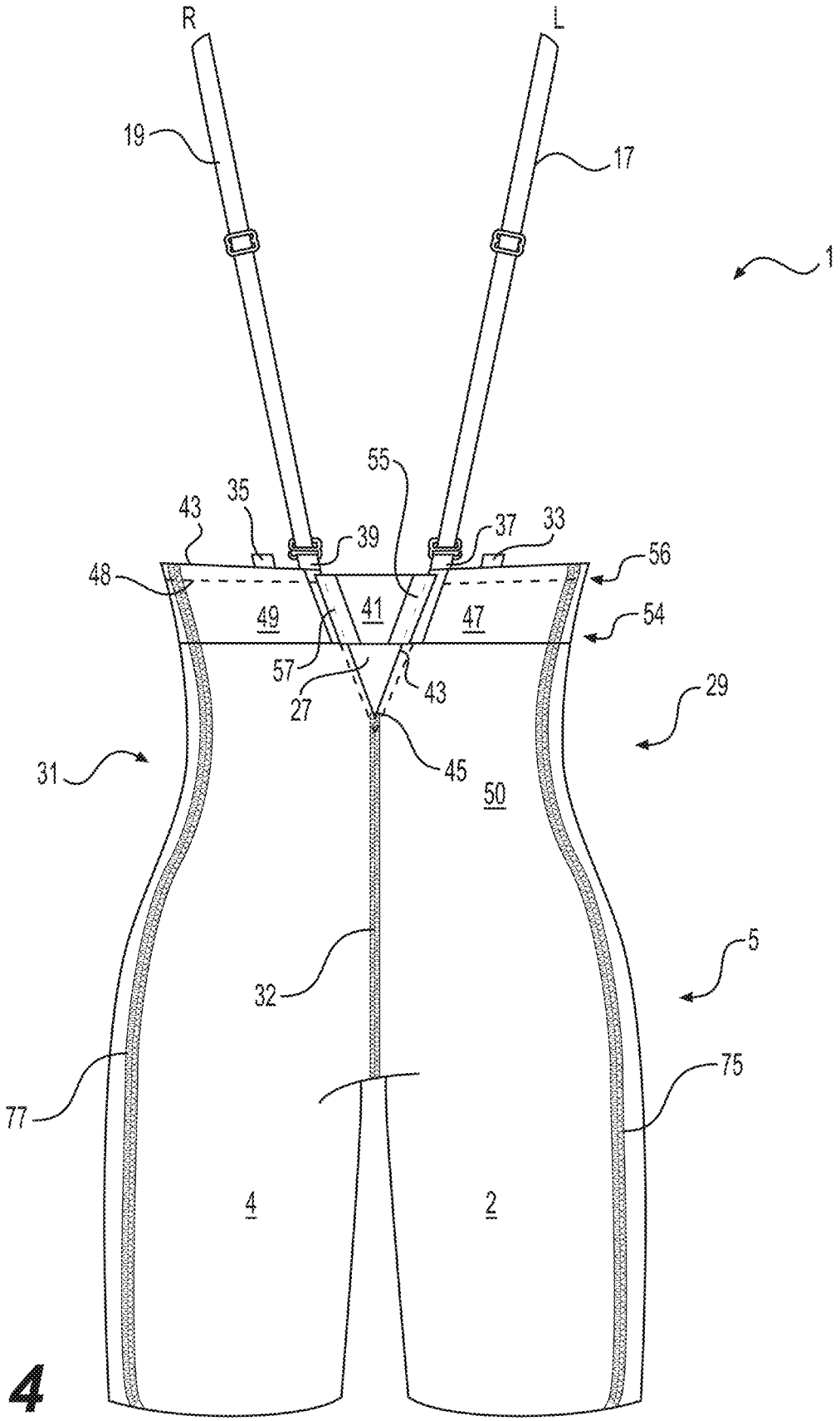
FIG. 4 illustrates a rear view of the inside of a shaping garment.

FIG. 3 shows the interior view of the front side of one embodiment of the shaping garment 1, as if the garment has been turned inside out. Left and right portions 47, 49 of an elastic band extend from the front side 3 to the rear side 5 of the shaping garment 1, as shown in FIG. 4. The elastic band serves to keep the shaping garment 1 in place on the wearer. It also increases comfort by stretching as the wearer moves, and provides a degree of fit flexibility to the garment 1. In the embodiment shown in FIG. 3, the left and right portions 47, 49 of the elastic band extend laterally along the front side 3 and are positioned inferior to the left and right breast supporting portions 13, 15. In this embodiment, the elastic band is positioned underneath the exterior-most layer of fabric 50 on both the front and rear sides 3, 5, such that it cannot be seen from the outside of the shaping garment 1. However, in other embodiments the elastic band could potentially form part of the exterior-most layer of fabric 50, either on the front side 3, the rear side 5, or both. While the elastic band of FIGS. 3 and 4 is divided into left and right portions 47, 49, in alternate embodiments the elastic band may remain undivided and extend fully across the front side 3. The height of the elastic band, from its inferior-most point to its superior-most point, is about 1.77 inches in the embodiment shown. However, in other embodiments the height of the elastic band can be from about 0.25 inches to about 4.00 inches. In still other embodiments, the height of the elastic band could be from about 0.25 inches to about 15.00 inches.

In the embodiment shown in FIGS. 3 and 4, the left and right portions 47, 49 of the elastic band are attached to the exterior-most layer of fabric 50, adjacent the front and rear superior edges 12, 43, with a lateral elastic band seam 48. The lateral elastic band seam 48 integrates the elastic band into the left and right front shaping regions 7, 9 and the left and right back shaping regions 29, 31 of the shaping garment 1. The lateral elastic band seam 48 extends laterally across a superior region 56 of the elastic band, whereas the inferior region 54 of the elastic band remains unattached. However, in other embodiments, the inferior region 54 can also be attached to the exterior-most layer of fabric 50. In the embodiment shown, lateral elastic band seam 48 is sewn to exterior-most layer of fabric using a zig-zag stitch. However, any number of stitch types that can stretch with the elastic band can be used to form lateral band seam 48. For example, other alternative stitch types could include, but are not limited to, a two or three needle bottom cover stitch, or a two or three needle top and bottom cover stitch. It is also possible to include one or more additional lateral band seams, such as the one shown as a dotted line and seen above seam 48 in FIG. 4.

Figure 13:
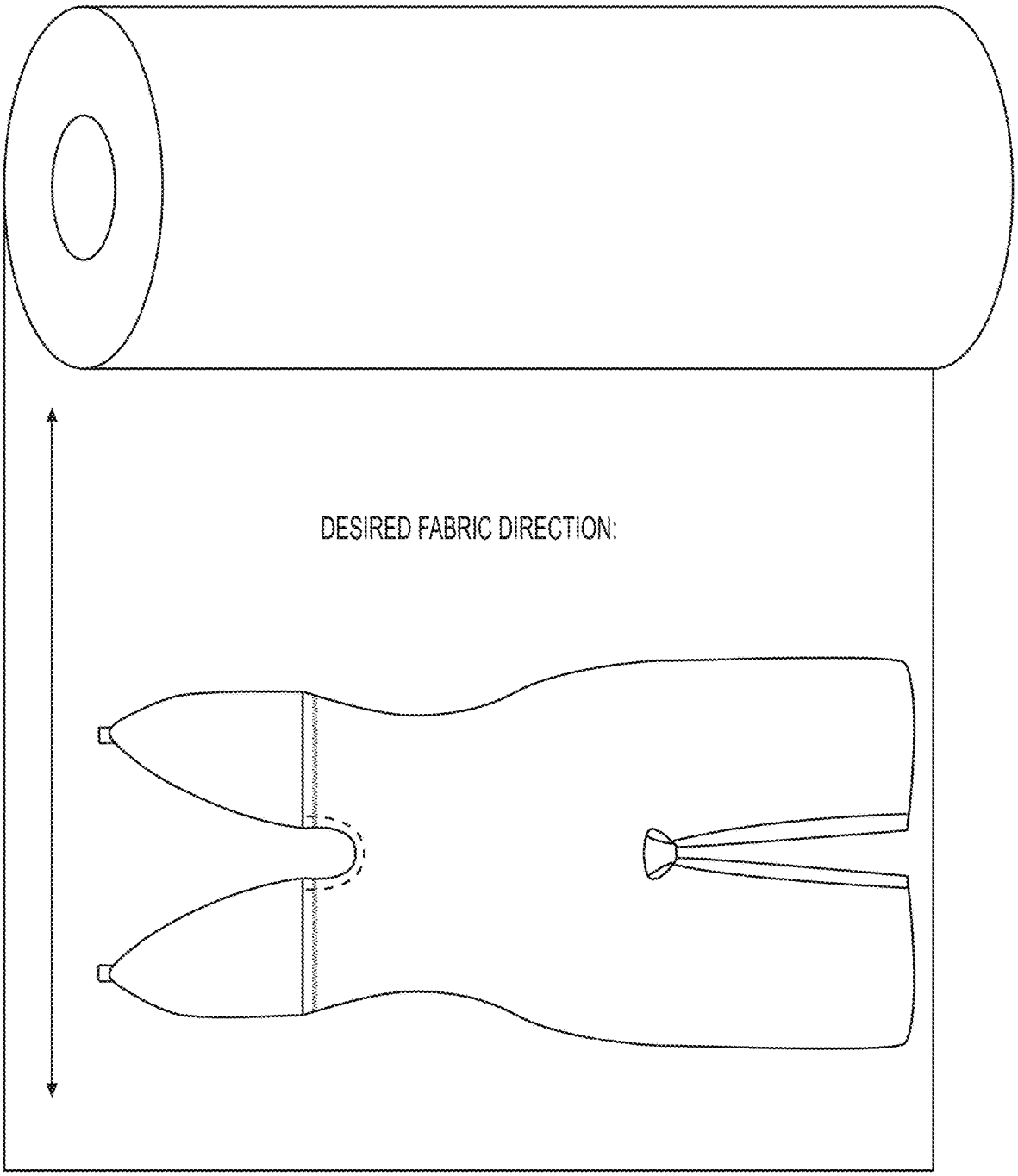
FIG. 13 illustrates the direction that the fabric of the exterior-most fabric can be cut.

In some embodiments, the exterior-most layer of fabric 50 can be formed of a knit material, for example, a warp knit material. In some embodiments, the exterior-most layer of fabric 50 is a tricot material. In some embodiments, the exterior-most layer of fabric 50 can be a microfiber material. In some embodiments, the exterior-most layer of fabric 50 can include nylon and elastane, for example, 49% nylon and 51% elastane. The outer component can, in some embodiments, be about 190 grams per square inch. The exterior-most layer of fabric 50 can be cut as shown in FIG. 13. For example, if the fabric is a knit fabric, the courses can be aligned lengthwise in a superior to inferior direction along the shaping garment 1.

Figure 5:
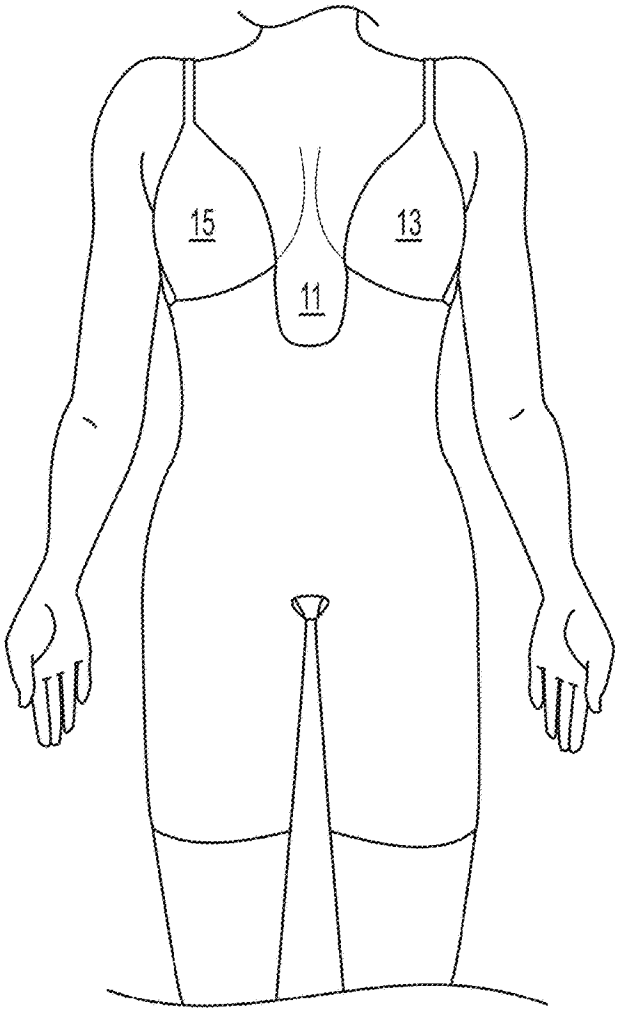
FIG. 5 illustrates a front view of the outside of a shaping garment on a wearer.
Figure 11:
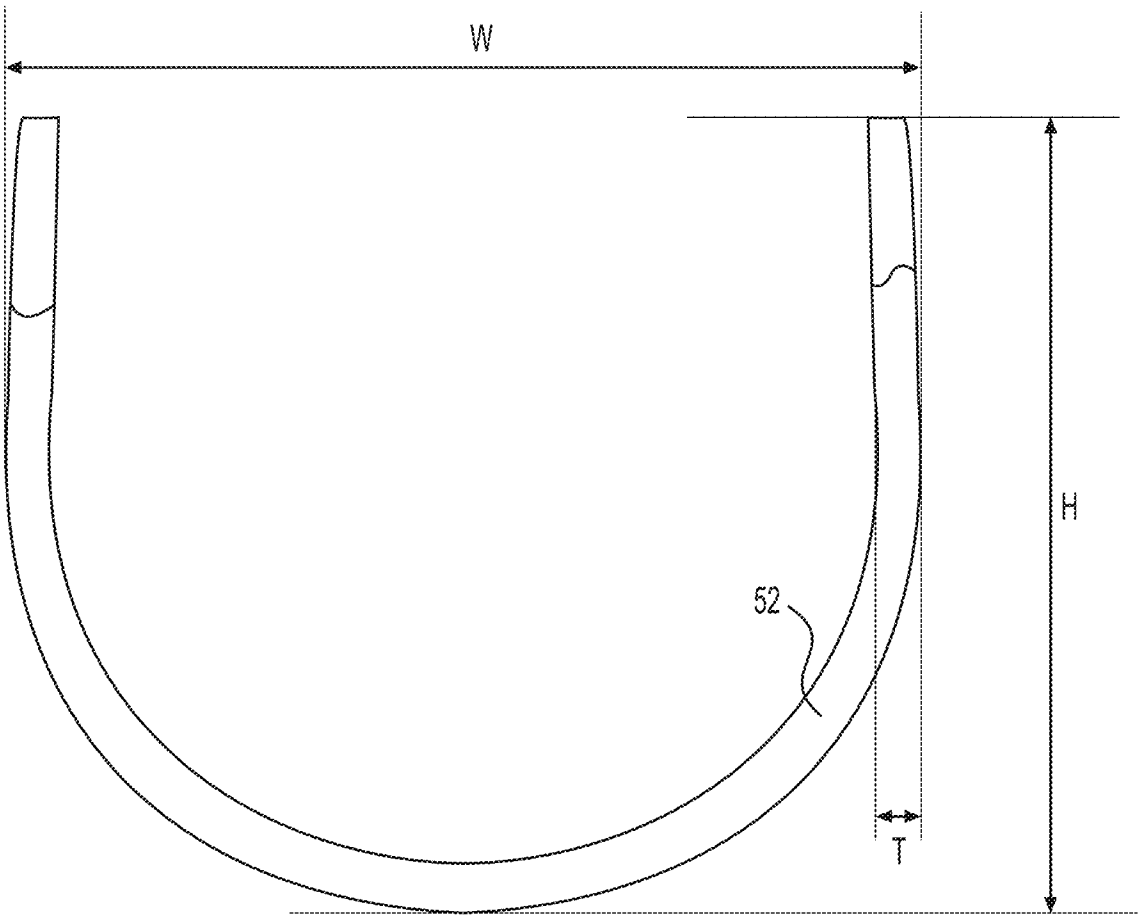
FIG. 11 illustrates a U-shaped wire.

In the embodiment shown in FIG. 3, the left portion 47 of the elastic band is affixed to a left side 51 of a U-shaped wire 52, and the right portion 49 of the elastic band is affixed to the right side 53 of the U-shaped wire 52. The U-shaped wire may be enclosed in a wire casing to facilitate its attachment to the shaping garment 1. The purpose of the U-shaped wire 52 is to provide additional breast support, limiting the amount that left and right breast supporting portions 13, 15 can move away from the U-shaped space 11 during wear. The shape of the U-shaped wire 52 is comfortable and gives the wearer many options for different plunging necklines by leaving a large portion of the lower chest exposed. FIG. 5 shows the front side 3 of the shaping garment 1 on a wearer. The U-shaped wire 52 enhances cleavage by limiting the extent that the wearer's breasts can separate (despite breast supporting portions 13, 15 not being directly attached to each other). The U-shaped wire is shown in greater detail in FIG. 11. The wire can be rectangular in cross section such that it will lay flat against the wearer's chest. Alternatively, the U-shaped wire 52 could be square, circular, or elliptical in cross section. The wire of the embodiment shown in FIG. 11 is about 0.13 inches thick, the thickness t being measured as the greatest distance between one side of the U-shaped wire 52 and the other side of the U-shaped wire 52. The height h of the U-shape made by the wire 52 is about 2.25 inches (from the inferior-most point of the U to the superior-most point of the U) and the width w of the U-shape made by the wire 52 is about 2.50 inches (from the left side of the U to the right side of the U). In other embodiments, the thickness of the wire 52 could range from 0.05 to 0.50 inches, the height of the U-shape could range from 0.50 to 4.00 inches, and the width of the U-shape could range from 0.5 to 4.00 inches.

Figure 6:
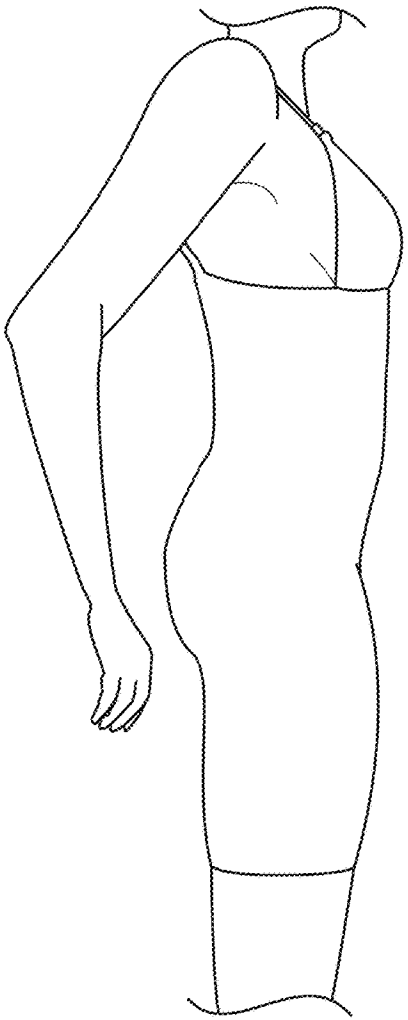
FIG. 6 illustrates a side view of the outside of a shaping garment on a wearer.

Left and right breast supporting portions 13, 15 can each include an inner breast cup and an outer breast cover. In some examples, the breast supporting portions 13, 15 can also include a strip of supporting fabric at the lateral sides of the breast supporting portions 13, 15. The strip of supporting fabric can be positioned between an inner, foam cup and the outer layer of fabric, remaining hidden to the wearer. The strip of supporting fabric increases the rigidity of the lateral sides of breast supporting portions 13, 15, to prevent it from stretching and to provide additional breast support during wear, as shown in the side view of the shaping garment 1 on a wearer in FIG. 6.

FIG. 4 shows the interior view of the rear side of one embodiment of the shaping garment 1, as if the garment has been turned inside out. Removable back adjuster 41 is shown adjoining the left and right back shaping regions 29, 31 and bridging the space 27. In the embodiment shown, the left portion 47 of the of the elastic band attaches to the left side 55 of the removable back adjuster, and the right portion 49 of the elastic band attaches to the right side 57 of the removable back adjuster.

FIG. 10 is an exterior view showing additional detail of an example embodiment of a removable back adjuster 41 and the left and right closure mechanisms, 59, 61. In this embodiment, a portion of each of the left and right closure mechanisms 59, 61 is located on the removable back adjuster 41, whereas the corresponding portion of each of the left and right closure mechanisms 59, 61 is located on the left and right portions 47, 49 of the elastic band, enabling the removable back adjuster 41 to be attached to the left and right portions 47, 49 of the elastic band. In this embodiment, the left and right closure mechanisms comprise hooks 63 and eyes 65. The eyes 65 are positioned on the left and right portions 47, 49 of the elastic band, and the hooks 63 are positioned on both the left and right exterior sides of the removable back adjuster 41, curving outward and away from the wearer. However, the hooks and eyes could take any variety of positions and orientations, so long as they serve to attach the removable back adjuster 41 to the left and right back shaping regions 29, 31 of the shapewear garment 1. Furthermore, the left and right closure mechanisms could comprise any of a known variety of closure mechanisms, including, but not limited to snaps, ribbon ties, zippers, hook and loop fasteners (such as Velcro®), buttons and/or one or more slidable hook fasteners. A slidable hook fastener includes a slidable hook that lays generally flat against the wearer's body. The slidable hook can attach to an elongated loop or, in some embodiments, to another slidable hook fastener.

Referring still to FIG. 10, a highly elastic region 67 is positioned between the portions of the left and right closure mechanisms 59, 61 located on the removable back adjuster 41. In the embodiment shown, the highly elastic region 67 can be approximately the same height as the left and right portions 47, 49 of the elastic band. The highly elastic region 67 may be formed of the same material as the elastic band. However, in other embodiments the highly elastic region 67 of the removable back adjuster 41 can be a different height and/or a different material that the left and right portions 47, 49 of the elastic band. The height h of the highly elastic region 67 can be, for example, from about 0.25 inches to about 4.00 inches. In the embodiment shown, the width w of the back adjuster 41, from the left-most point to the right-most point, is about 2.50 inches. However, the width can range anywhere from about 0.50 to about 5.00 inches.

Methods of making the shaping garment 1 are also disclosed. The method of making can include cutting a left rear panel 69 from a fabric sheet such that the left rear panel 69 narrows as it extends toward a superior portion of the left rear panel to create a narrowing left superior rear portion, and cutting a right rear panel 71 from a fabric sheet such that the right rear panel 71 narrows as it extends toward a superior portion of the right rear panel to create a narrowing right superior rear portion. The method can further include attaching a portion of a left closure mechanism 59 to the right edge of the narrowing left superior rear portion, and attaching a portion of a right closure mechanism 61 to the left edge of the narrowing right superior rear portion. The right inferior edge of the left rear panel 69 can be sewn to a left inferior edge of the right rear panel 71 to form a rear side 5 of the shaping garment. The narrowing left superior rear portion and the narrowing right superior rear portion can remain unattached, thereby defining the space 27 in the rear side 5 of the shaping garment 1. The joining of the left and right rear panels form a central back seam 32. In some examples, central back seam 32 can be formed using an overlock stitch. However, any variety of stitch types can be used to form the central back seam. The method can also include sewing the rear side 5 of the shaping garment to a front panel 73 to form left and right side seams 75, 77 and a front side 3 of the shaping garment 1. Some embodiments of the methods of making the shaping garment 1 can include attaching a removable back adjuster 41 to the left and right closure mechanisms 59, 61, to bridge the space 27.

Some methods can include attaching at least one elastic band along an interior, superior edge 43 of the rear side 5 of the shaping garment 1. For example, a left portion 47 of an elastic band can be extended from the interior, rear side 5 of the shaping garment 1 to the front side 3 of the shaping garment 1, and a right portion 49 of an elastic band can be extended from the interior, rear side 5 of the shaping garment 1 to the front side 3 of the shaping garment 1. The left and right portions 47, 49 of the elastic band can be attached to a U-shaped wire 52 on the front side 3 of the shaping garment 1. The methods can also include attaching a left facing elastic to the right edge of the narrowing left superior rear portion and attaching a right facing elastic to the left edge of the narrowing right superior rear portion.

In some embodiments, the left and right breast supporting portions 13, 15 can be constructed as follows. A first layer of foam is covered (flat) on a top side with a first layer of fabric and on a bottom side with a second layer of fabric. The first and second fabric layers are bonded or laminated to the layer of foam. The foam surrounded by the first and second fabric layers is then molded with heat to the shape of the cup. A third, outer layer of fabric is molded separately, then sewn to the front of the cup. In some embodiments, fabrics used in cup construction are able to withstand high temperatures and take the shape of the mold while remaining pliable. In some embodiments, a strip of supporting fabric can be positioned between the layers, at the lateral sides of the breast supporting portions 13, 15.

In some embodiments of the methods, left and right breast supporting portions 13, 15 can be attached along a superior edge 12 of the front side 3 of the shaping garment 1. A superior region 56 of the elastic band or superior regions 56 of the left and right portions 47, 49 of the elastic band can be attached to an interior, superior edge 12 of the front panel 73 and to the inferior edges of the left and right breast supporting portion 13, 15. Finally, a superior edge 12 of the front panel 73 can be attached to a U-shaped wire 52 or to a casing that encloses the U-shaped wire 52. The U-shaped wire 52 or the casing that encloses the U-shaped wire 52 can be attached the left and right elastic band portions 47, 49 and to the left and right breast supporting portions 13, 15.

Figure 14:
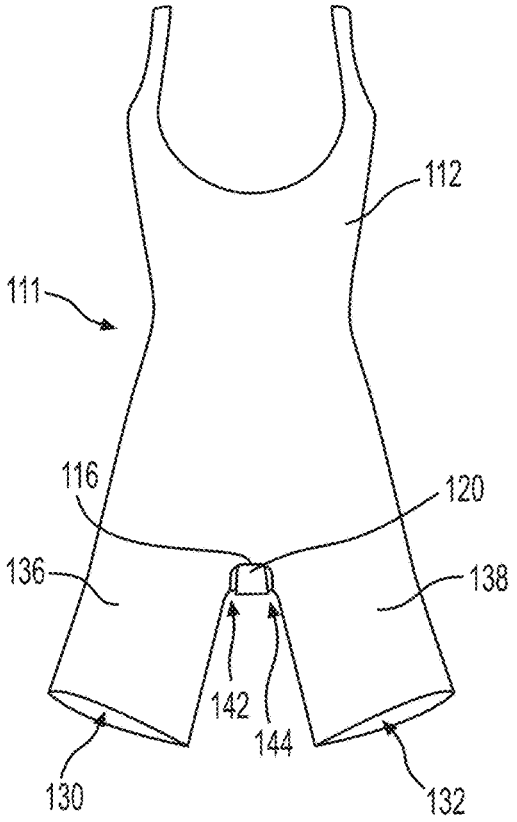
FIG. 14 is a front view of a garment having a stretchable gusset panel.
Figure 15:
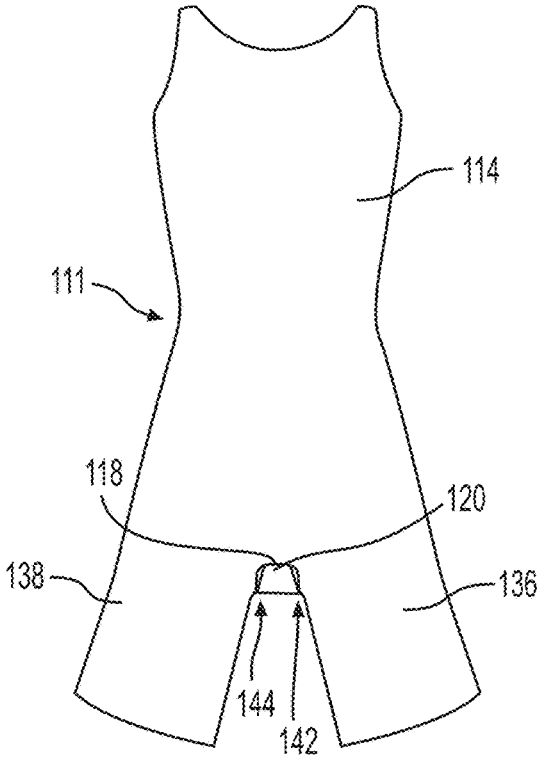
FIG. 15 is a back view of the garment embodiment of FIG. 14.

FIG. 14 and FIG. 15 illustrate front and back views of a garment having a stretchable gusset panel 120. The garment includes a front body panel 112, a back body panel 114, a right leg portion 136 and a left leg portion 138. Each leg portion is attached to the front body panel 112 and the back body panel 114. The right leg portion 136 encircles the right leg space 130, and the left leg portion 138 encircles the left leg space 132. In certain embodiments, the front body panel 112, the back body panel 114, the right leg portion 136 and the left leg portion 138 are separate pieces of fabric and are attached with a seam, bonding, or other attachment method known in the art. In other embodiments, the front body panel 112, the back body panel 114, the right leg portion 136 and the left leg portion 138 are formed continuously from the same piece of fabric. In certain embodiments, the right leg portion 136 and the left leg portion 138 are formed continuously with the front body panel 112 and/or the back body panel 114, as shown in FIG. 14 and FIG. 15. In other embodiments, the right leg portion 136 and the left leg portion 138 are attached to the front body panel 112 and the back body panel 114 by a seam, by bonding, or by other methods of joining fabric known in the art. In some embodiments, the front body panel 112 may be formed of multiple separate pieces of fabric attached with a seam or other attachment method (for example, a seam extending up the center of the front side of the garment). In some embodiments, the back body panel 114 may be formed of multiple separate pieces of fabric attached with a seam or other attachment method (for example, a seam extending up the center of the back side of the garment). The front body panel 112 and back body panel 114 can comprise any fabric known in the art for use in shapewear or other undergarments.

Figure 16:
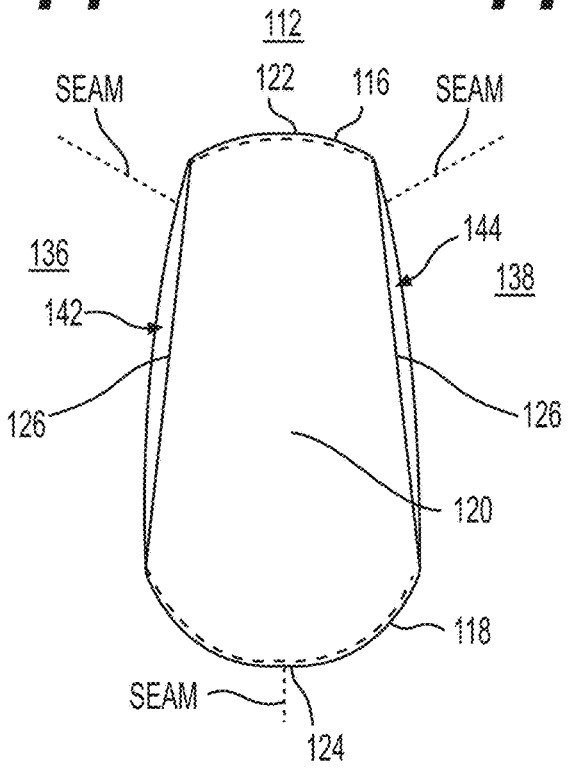
FIG. 16 is an exterior (bottom up) view of the gusset panel of the undergarment embodiment of FIGS. 14 and 15.

The undergarments disclosed herein include a gusset panel 120 located in a crotch region of the undergarment. The gusset panel 120 can be a separate piece of material than the front or back body panels 112, 114. It can be joined to one or both of the front and/or back body panels 112, 114 by a seam or bonding. FIG. 16 illustrates an exterior view of a gusset panel 120. The gusset panel 120 has a front gusset panel edge 122, a back gusset panel edge 124, and two lateral gusset panel edges 126 extending between the front gusset panel edge 122 and the back gusset panel edge 124. At least a portion of each of the two lateral gusset panel edges 126 are not attached to the front body panel 112 or back body panel 114. In some embodiments, at least a portion of the two lateral gusset panel edges 126 are unattached to any other portion of the garment. By contrast, the front gusset panel edge 122 is attached along the lower edge 116 of the front body panel, and the back gusset panel edge 124 is attached along the lower edge 118 of the back body panel (the dotted lines along the front gusset panel edge 122 and back gusset panel edge 124 illustrate where the gusset panel is attached to the garment). In certain embodiments, the gusset panel 120 is continuously knitted to one or both of the front body panel 112 and the back body panel 114.

One or more access spaces 142, 144 are located in the crotch portion, allowing the wearer to stretch the gusset panel 120 aside removing the garment. In the example embodiment shown in FIGS. 14-16, the right leg portion 136 and one lateral gusset panel edge 126 define a first access space 142, and the left leg portion 138 and a second lateral gusset panel edge 126 define a second access space 144. In some embodiments, one of the lateral gusset panel edges can be attached to a leg portion, while the other lateral gusset panel edge remains unattached, forming a single access space. The dotted lines extending from the right access space 142 and left access space 144 illustrate a seam in the leg portions. This is to give context to the figure and is not intended to limit the invention.

The gusset panel 120 is not intended to be limited to any particular shape. In certain embodiments, the gusset panel is generally rectangular in shape, with linear front and back gusset panel edges 122, 124 that are equal in length. In other embodiments, such as the one shown in FIG. 16, the front gusset panel edge 122 and/or back gusset panel edge 124 may be curved, and the back gusset panel edge may be wider than the front gusset panel edge. As used herein, the width indicates a direction from left to right across the gusset panel 120. The length indicates a direction from front to back across the gusset panel 120. In certain embodiments, the gusset panel is one layer of fabric. In other embodiments, the gusset panel is two or more layers of fabric. The two or more layers of fabric can be attached by a seam, by bonding, or by other methods known in the art for joining more than one layer of fabric.

Figure 17:
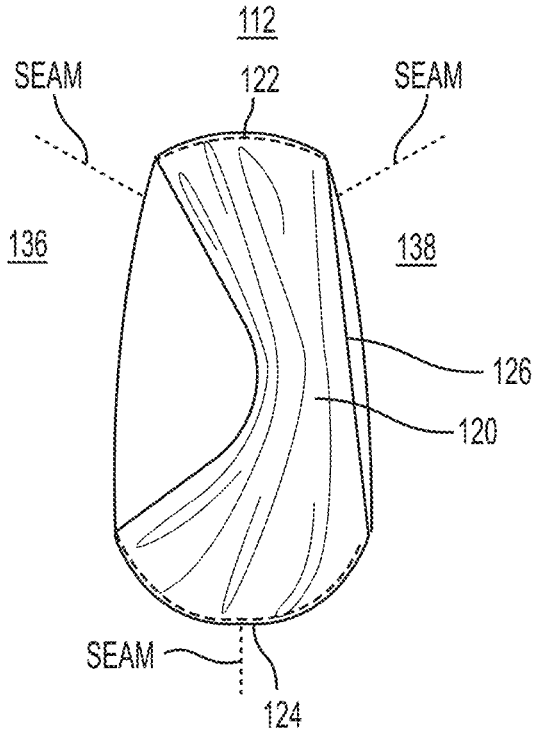
FIG. 17 is an exterior view of a gusset panel stretched to one side.

The gusset panels disclosed herein are formed of stretchable fabrics so that they can be stretched to the side, as shown in FIG. 17. The fabric of the gusset panel 120 has high elongation properties, such that it generally lays flat against the body of the wearer, but is also able to be stretched to the side. In some embodiments, the gusset panel 120 has a higher elasticity than the front body panel 112 and/or the back body panel 114. The tension force of the fabric can be determined by test method ASTM D4964-1996(2008), Tensile Testing Machine, Constant Rate of Extension. A loop specimen of 250 millimeters in loop length is placed around the clamps of a testing machine. The machine speed is 500 millimeters/minute. The specimen is cycled three times from zero to 100 Newton (N) load. During the third extension-load cycle, the percent elongation is measured, as is the tension force at 30%, 50%, and 70% elongation. In certain embodiments, the gusset panel fabric has a tension force in the length direction of from about 0 N to about 0.4 N at 30% elongation, from about 0.2 N to about 3 N at 50% elongation, and from about 1 N to about 6 N at 70% elongation. In certain embodiments, the gusset panel fabric has a tension force in the width direction of from about 0 N to about 0.4 N at 30% elongation, from about 0.2 N to about 3 N at 50% elongation, and from about 1 N to about 6 N at 70% elongation. In certain embodiments, the gusset panel has an elongation of from about 100% to about 700% in the length direction at 100 N load. In certain embodiments, the gusset panel has an elongation from about 100% to about 700% in the width direction at 100 N load.

In some embodiments, the level of elongation of gusset panel 120 in the length or width direction can be modified, for example, by varying the types of yarns or stitch patterns used to make the gusset panel 120. In some embodiments, the level of elongation of the gusset panel can be modified, for example, by varying the types of yarns or stitch patterns used to make the seams attaching gusset panel 120 to the front body panel and the back body panel.

The fabric of the gusset panel 120 has recovery such that it returns to its original shape after being stretched. After repeated uses, the gusset panel will still generally lay flat against the wearer's body. The fabric recovery is tested after the third extension-load cycle of test method ASTM D4964-1996(2008), described above. Immediately after the third cycle, the fabric is removed from the loop and allowed to relax for 60 seconds. The length of the loop is measured after relaxing for 60 seconds. The percentage recovery of the fabric is calculated as: the original length divided by the length after the third cycle (including the 60 second rest), then multiplied by 100. In certain embodiments, the gusset panel fabric has a recovery of from about 80% to about 100% after the three extension-load cycles. In certain embodiments, the gusset panel 120 comprises a knit fabric. In certain embodiments, the gusset panel comprises a fabric made on a seamless knitting machine. In certain embodiments, the gusset panel comprises a hosiery fabric. The hosiery fabric can be made through any method known in the art, including circular knitting. Hosiery fabric can be produced using hosiery yarn. In certain embodiments, the weight of the fabric is from about 20 grams per square meter (gsm) to about 500 gsm. In certain embodiments, the fabric is 100 gsm. In certain embodiments, the gusset panel comprises a warp knit fabric. In certain embodiments, the gusset panel comprises a tube elastic. In certain embodiments, the gusset panel comprises a jersey knit fabric. In certain embodiments, the gusset panel comprises nylon. In certain embodiments, the gusset panel comprises spandex. In certain embodiments, the gusset panel comprises a blend of fiber types. In certain embodiments, the gusset panel comprises a nylon and spandex blend. In an embodiment, the gusset panel comprises 80% nylon and 20% spandex. In certain embodiments, the gusset panel comprises a non-woven material. In certain embodiments, the gusset panel comprises a polymer film.

Figure 18:
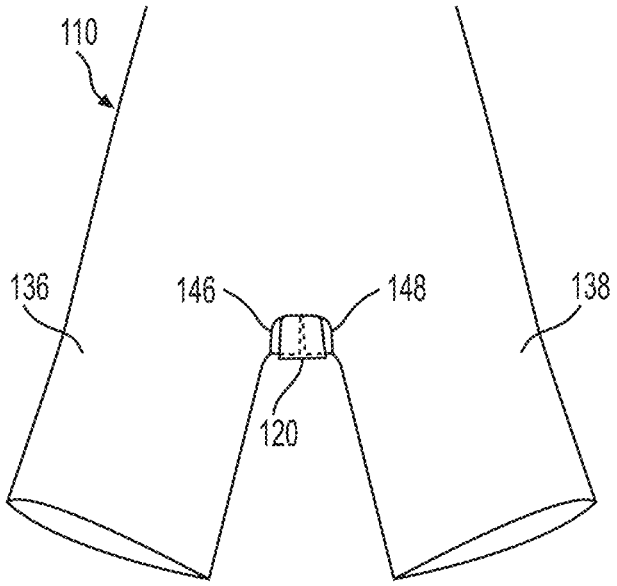
FIG. 18 is a front view of an undergarment embodiment having a gusset panel, a left side cover panel, and a right side cover panel.
Figure 19:
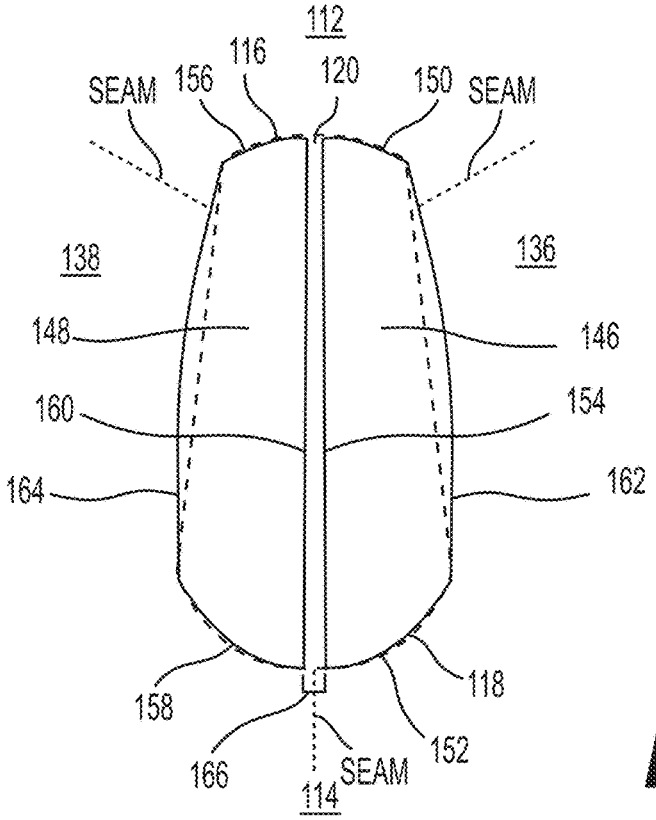
FIG. 19 is an interior (top down) view of the undergarment embodiment of FIG. 18, having a gusset panel, a left leg portion, a right leg portion, a left side cover panel, and a right side cover panel.
Figure 20:
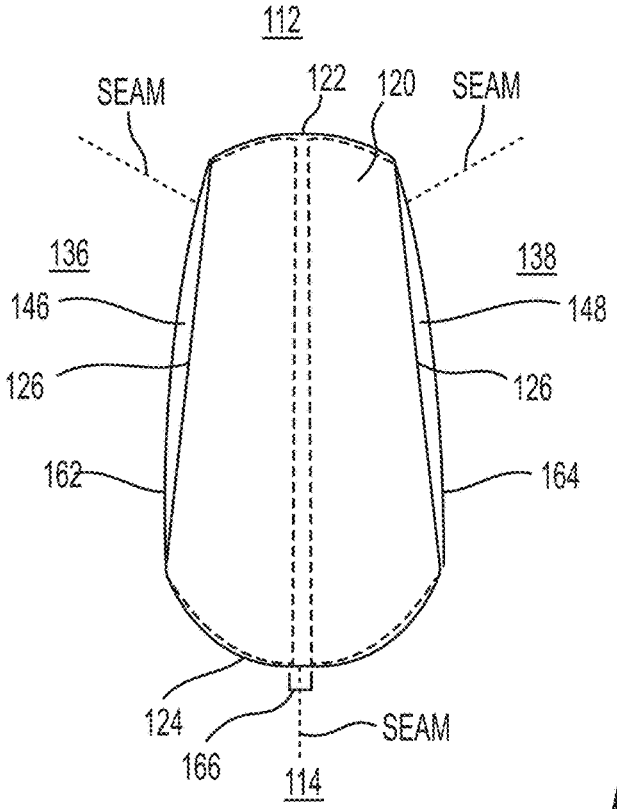
FIG. 20 is an exterior (bottom up) view of the undergarment embodiment of FIGS. 18 and 19.

Some embodiments can include cover panels that extend inward from the front body panel, the back body panel, and/or the leg portions to narrow the access space, overlapping the gusset panel and reducing exposure to provide the wearer with added modesty. FIG. 18 illustrates an embodiment of a garment having a right leg portion 136, a left leg portion 138, a right side cover panel 146, a left side cover panel 148, and a gusset panel 120. FIG. 19 and FIG. 20 illustrate interior (top down) and exterior (bottom up) views, respectively, of the crotch region of the garment of FIG. 18. The dotted lines in FIG. 19 indicate the positioning of the gusset panel 120 beneath the cover panels 146, 148, whereas the dotted lines in FIG. 20 indicate the positioning of the cover panels 146, 148 behind the gusset panel 120. The right side cover panel 146 and the left side cover panel 148 extend inward from leg portions 136, 138 toward access space 166. The access space 166 is defined by the right inside access edge 154 of the right side cover panel 146 and the left inside access edge 160 of the left side cover panel 148. The right side cover panel 146 and left side cover panel 148 are configured to contact or be in close proximity to the wearer's body. The gusset panel 120 is located on the exterior of the garment, but still able to contact the body through the access space 166. In certain embodiments, the left inside access edge 160 and the right inside access edge 154 are directly adjacent. In other embodiments, the left inside access edge 160 and the right inside access edge 154 are spaced apart. In some embodiments, the width of the access space 160 (as measured between the left inside access edge 160 and the right inside access edge 154 when the garment is not being worn) is less than the width of the gusset panel 120.

Figure 21:
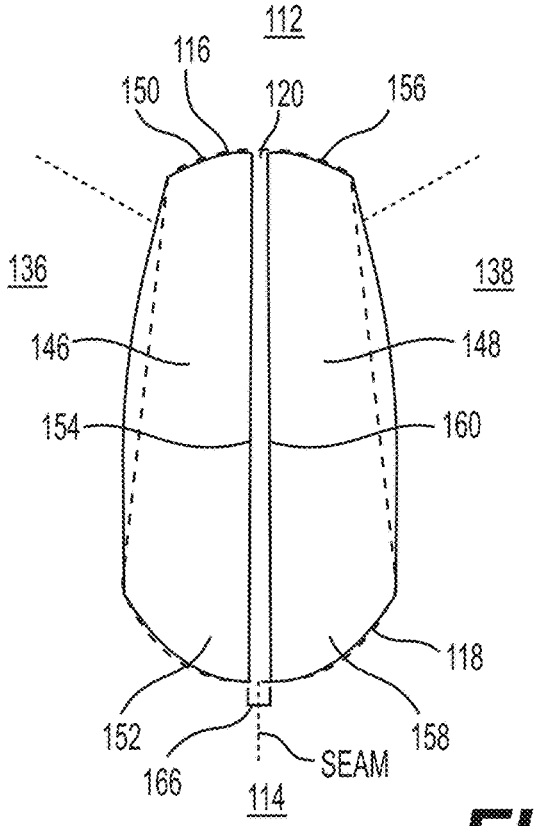
FIG. 21 is an exterior (bottom up) view of an alternative embodiment of undergarment having a gusset panel, a left leg portion, a right leg portion, a left side cover panel, and a right side cover panel.
Figure 22:
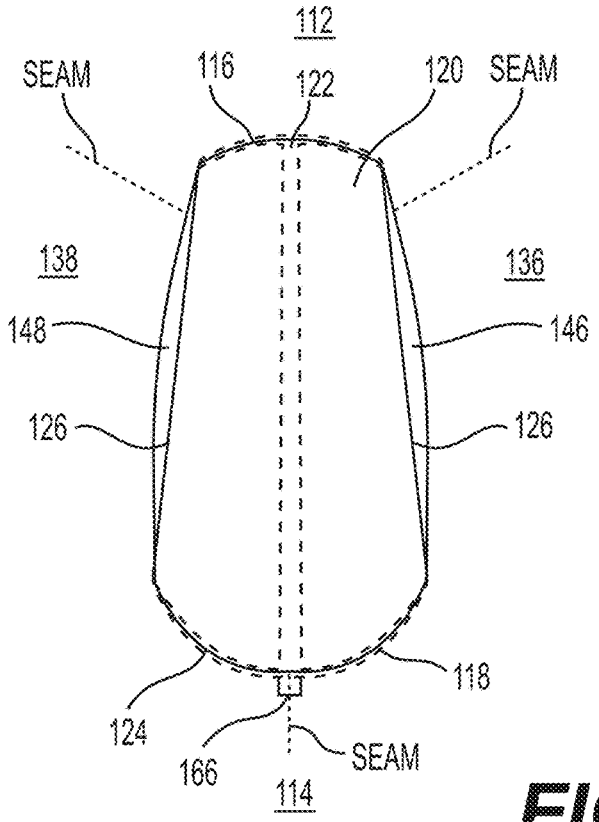
FIG. 22 is an interior (top down) view of the undergarment embodiment of FIG. 21.

FIG. 21 illustrates an exterior view of an alternative embodiment wherein the gusset panel 120 is located on the interior of the garment and is configured to contact the wearer's body, and the right side cover panel 146 and left side cover panel 148 are located on the exterior of the garment. FIG. 22 illustrates an interior view of the garment shown in FIG. 21, showing the gusset panel 120, the right side cover panel 146, and the left side cover panel 148.

Side cover panels 146, 148 are attached to the crotch region of the garment by, for example, stitching, bonding, or any other methods of attachment known in the art. Referring back to FIG. 19, the right side cover panel 146 has a right front cover panel edge 150, a right back cover panel edge 152, a right inside access edge 154, and a right outside cover panel edge 162. The left side cover panel 148 has a left front cover panel edge 156, a left back cover panel edge 158, a left inside access edge 160, and a left outside cover panel edge 164. The right front cover panel edge 150 and the left front cover panel edge 156 are attached to the front body panel lower edge 16, and the right back cover panel edge 152 and the left back cover panel edge 158 are attached to the back body panel lower edge 118. The right and left outside cover panel edges 162, 164 can be stitched or bonded to the front panel 112, the back panel 114 and/or the leg portions 136, 138. For embodiments with leg portions 136, 138 that are continuous with the front and back body panels 112, 114, the attachments of the cover panels 146, 148 in the crotch region of the garment occurs in a transition zone where the leg portions 136, 138 begin. In some embodiments, one or more sides of the cover panels may be continuously formed with the front body panel, the back body panel, and/or the leg portions of the garment.

Figure 23:
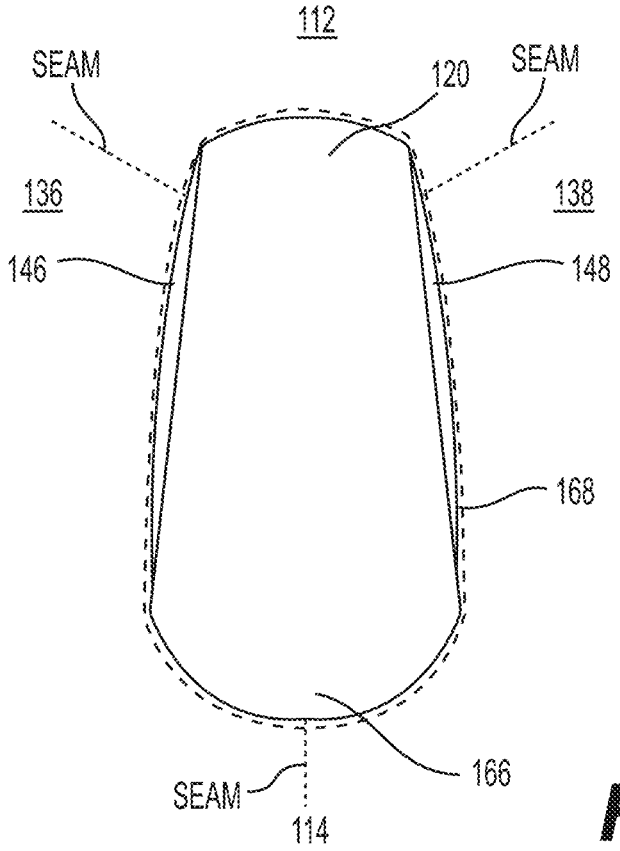
FIG. 23 is an exterior view of an undergarment embodiment, wherein the gusset panel, the left side cover panel and the right side cover panel are attached to the garment with a continuous seam.

As illustrated in FIG. 23, the gusset panel 120, right side cover panel 146, and left side cover panel 148 may all be connected to the front body panel 112, the back body panel 114, and the leg portions with one continuous seam 168. The seam 1168 can be positioned on the inside or on the outside of the garment. The seam 168 is attached to the front, back and outside edges of the cover panels 146, 148, but only to the front and back edges of the gusset panel 120 (leaving the lateral edges 126 of the gusset panel 120 free). In certain embodiments, the seam 168 attaching the right and left side cover panels 146, 148 and the gusset panel 120 to the garment can be formed using an overlock stitch. The overlock stitch can be, for example, a three-thread overlock stitch or a four-thread overlock stitch. The width of the stitches can be from about 4 millimeters to about 5 millimeters. In certain embodiments, the seam 168 has from about 17 to about 24 stitches per inch. Any thread known in the art for sewing stretchable fabrics can be used for the seam 168. Preferred thread types include Coats SeamSoft or A&E Anesoft. In certain embodiments, tex 24 yarn is used. In certain embodiments, tex 18 yarn is used. In an embodiment, the seam 168 is an overlock stitch, where tex 24 yarn is used for the needles and tex 18 yarn is used for the loopers. In other embodiments, the side cover panels 146, 148 and the gusset panel 120 are attached to the front body panel and the back body panel by bonding. In certain embodiments, the gusset panel attachment is continuously knitted to one or both of the front body panel and the back body panel.

Figure 24:
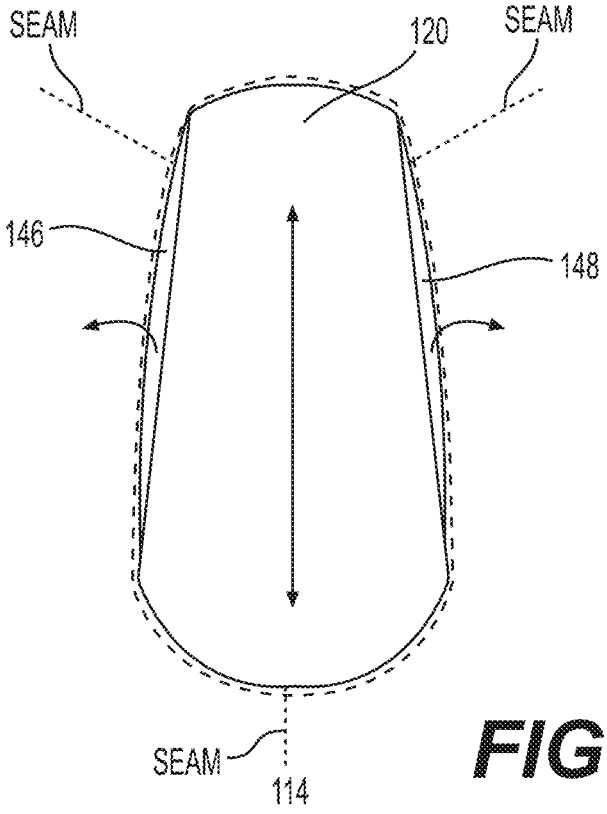
FIG. 24 is a view of the preferred direction of elongation of the gusset panel, left side cover panel, and right side cover panel.

In some embodiments, the fabric used to form the gusset panel 120 has equal elongation values in the length direction and the width direction (wherein width is measured from left to right and length is perpendicular to width). Likewise, the fabric used to form the cover panels 146, 148 can have equal elongation values in the length direction and the width direction. In other embodiments, these components may have greater elongation in one direction as compared to the other. FIG. 24 illustrates preferred directions of elongation for the gusset panel 120 and the right side cover panel 146 and the left side cover panel 148 in one embodiment. In this embodiment, the elongation of the gusset panel 120 is greater in the length direction than in the width direction, whereas the elongation of each cover panel 146, 148 is greater in the width direction than in the length direction.

Further disclosed herein are methods of making an undergarment having a gusset panel. Methods include forming a front body panel, a back body panel, a left leg portion, and a right leg portion. A front edge of a gusset panel is fixedly attached to a lower edge of a front body panel, and a back edge of the gusset panel is fixedly attached to a lower edge of a back body panel. At least a portion of a lateral gusset edge is left unattached to any part of the garment. The gusset panel can be fixedly attached to the front body panel and back body panel by a seam, by bonding, or by other methods. In other embodiments, methods of making the undergarment include seamlessly attaching a gusset panel to a front body panel and a back body panel. Left and right leg portions are seamlessly attached to the front and back body panels. At least a portion of a lateral gusset edge is left unattached to any part of the garment.

The method can further include fixedly attaching a left side cover panel to the front body panel, the back body panel, and the left leg portion such that the left side cover panel is overlapped by the left lateral gusset panel edge, and fixedly attaching a right side cover panel to the front body panel, the back body panel, and the right leg portion such that the right side cover panel is overlapped by the right lateral gusset panel edge. For example, a continuous seam can be used to fixedly attach the left side cover panel, the right side cover panel, the front gusset panel edge, and the back gusset panel edge. The continuous seam can extend around the cover panels as described above (i.e., it can attach the garment to the left front cover panel edge, the left outside cover panel edge, the left back cover panel edge, the right back cover panel edge, the right outside cover panel edge, and the right front cover panel edge). The same continuous seam can be used to attach the front gusset panel edge to the front body panel lower edge, the left front cover panel edge, and the right front cover panel edge, and to attach the back gusset panel edge to the back body panel lower edge, the left back cover panel edge, and the right back cover panel edge.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The implementation was chosen and described in order to best explain the principles of the invention and the practical application, and to enable others of ordinary skill in the art to understand the invention for various implementations with various modifications as are suited to the particular use contemplated.

The invention claimed is:

1. A method of making a shaping garment, the method comprising:

cutting a left rear panel from a first fabric sheet such that the left rear panel narrows as it extends toward a superior portion of the left rear panel to create a narrowing left superior rear portion;

cutting a right rear panel from the first fabric sheet or a second fabric sheet such that the right rear panel narrows as it extends toward a superior portion of the right rear panel to create a narrowing right superior rear portion;

sewing a right edge of the left rear panel to a left edge of the right rear panel to form a rear side of the shaping garment, wherein the narrowing left superior rear portion and the narrowing right superior rear portion remain unattached to define a rear-side widening space that diverges as it extends superiorly from a central seam on the rear side of the shaping garment;

sewing the rear side of the shaping garment to a front panel to form a front side of the shaping garment, wherein the front panel comprises a superior edge that defines a front-side widening space, the front-side widening space diverging as it extends superiorly from a front lowermost area; and attaching respective inferior portions of the left rear panel, the right rear panel, and the front panel to a gusset material such that the gusset material at least partially defines an elongated access space extending through a crotch region of the shaping garment between a left leg portion of the shaping garment and a right leg portion of the shaping garment.

2. The method of claim 1, wherein the gusset material comprises a left cover panel and a right cover panel, and the method further comprises attaching the left cover panel to the left leg portion and attaching the right cover panel to the right leg portion.

3. The method of claim 1, wherein the gusset material is a single, maneuverable gusset panel, and the method further comprises attaching a front gusset panel edge to the front side, or attaching a back gusset panel edge the rear side, or both, and wherein at least one of the front gusset panel edge, the back gusset panel edge, a left gusset panel edge, or a right gusset panel edge is left unattached to the garment.

4. The method of claim 1, wherein the gusset material has a curved back edge, and the method comprises sewing the curved back edge of the gusset material to the left rear panel, the right rear panel, or both.

5. The method of claim 1, wherein providing a front panel comprises cutting the front panel from the first fabric sheet, the second fabric sheet, or a third fabric sheet.

6. The method of claim 1, wherein the front-side widening space diverges extending away from a central point configured to be positioned at or below a bust of a wearer.

7. The method of claim 6, wherein the front-side widening space is V-shaped.

8. The method of claim 1, wherein the front-side widening space separates a left breast supporting portion from a right breast supporting portion, and the method further comprises attaching a band of material to the front side at a position inferior to the left breast supporting portion, the right breast supporting portion, or both.

9. The method of claim 8, further comprising attaching the band of material to a rear side of the shaping garment.

10. The method of claim 1, wherein the rear-side widening space comprises an angular region directly adjacent to the central seam on the rear side.

11. A method of making a shaping garment, the method comprising:

cutting a left rear panel from a first fabric sheet such that the left rear panel narrows as it extends toward a superior portion of the left rear panel to create a narrowing left superior rear portion;

cutting a right rear panel from the first fabric sheet or a second fabric sheet such that the right rear panel narrows as it extends toward a superior portion of the right rear panel to create a narrowing right superior rear portion;

sewing a right edge of the left rear panel to a left edge of the right rear panel to form a rear side of the shaping garment, wherein the narrowing left superior rear portion and the narrowing right superior rear portion remain unattached to define a rear-side widening space that diverges as it extends superiorly from a rear lowermost area on the rear side of the shaping garment;

sewing the rear side of the shaping garment to a front panel to form a front side of the shaping garment, wherein the rear-side widening space is arranged in a superior position on the shaping garment;

coupling a left shoulder strap tab to the narrowing left superior rear portion adjacent the rear-side widening space and coupling a right shoulder strap tab to the narrowing right superior rear portion adjacent the rear-side widening space;

coupling a left closure mechanism to the narrowing left superior rear portion at a position inferior to the left shoulder strap tab and coupling a right closure mechanism to the narrowing right superior rear portion at a position inferior to the right shoulder strap tab;

attaching a left breast supporting portion and a right breast supporting portion to the front side of the shaping garment; and attaching respective inferior portions of the left rear panel, the right rear panel, and the front panel to a gusset material such that the gusset material at least partially defines an elongated access space extending through a crotch region of the shaping garment between a left leg portion of the shaping garment and a right leg portion of the shaping garment.

12. The method of claim 11, wherein the gusset material comprises a left cover panel and a right cover panel, and the method further comprises attaching the left cover panel to the left leg portion and attaching the right cover panel to the right leg portion.

13. The method of claim 11, wherein the gusset material is a single, maneuverable gusset panel, and the method further comprises attaching a front gusset panel edge to the front side, or attaching a back gusset panel edge the rear side, or both, and wherein at least one of the front gusset panel edge, the back gusset panel edge, a left gusset panel edge, or a right gusset panel edge is left unattached to the garment.

14. The method of claim 11, wherein the gusset material has a curved back edge, and the method comprises sewing the curved back edge of the gusset material to the left rear panel, the right rear panel, or both.

15. The method of claim 11, further comprising cutting the front panel from the first fabric sheet, the second fabric sheet, or a third fabric sheet.

16. The method of claim 11, wherein the left breast supporting portion and the right breast supporting portion each have a lateral side comprising a hidden rigidifying material.

17. The method of claim 11, further comprising coupling a curved wire to the left breast supporting portion, the right breast supporting portion, or both.

18. The method of claim 11, wherein the rear-side widening space is U-shaped.

19. The method of claim 11, further comprising providing a removable back adjuster, the removable back adjuster configured to couple the left closure mechanism to the right closure mechanism.

20. A method of making a shaping garment, the method comprising:

coupling a rear side of the shaping garment to a front side of the shaping garment, wherein the rear side defines a rear-side widening space between a left back covering region and a right back covering region, the rear-side widening space diverging as it extends superiorly from a rear lowermost area on the rear side of the shaping garment, and wherein the front side defines a front-side widening space between a left breast covering portion and a right breast covering portion, the front-side widening space diverging as it extends superiorly from a front lowermost area on the front side of the shaping garment;

coupling a left shoulder strap tab to the rear side at a position to the left of the rear-side widening space and coupling a right shoulder strap tab to the rear side at a position to the right of the rear-side widening space;

coupling a left closure mechanism to the rear side at a position inferior to the left shoulder strap tab and coupling a right closure mechanism to the rear side at a position inferior to the right shoulder strap tab; and providing a removable back adjuster, the removable back adjuster configured to couple the left closure mechanism to the right closure mechanism.

21. The method of claim 20, wherein the front-side widening space diverges extending away from a central point.

22. The method of claim 21, wherein the front-side widening space is V-shaped.

23. The method of claim 20, wherein the rear-side widening space is U-shaped.

* * * * *